US007850471B2

(12) United States Patent
Imai

(10) Patent No.: US 7,850,471 B2
(45) Date of Patent: Dec. 14, 2010

(54) SHORTING TERMINAL, CONNECTOR AND SHORTING METHOD

(75) Inventor: Yuujirou Imai, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 12/426,688

(22) Filed: Apr. 20, 2009

(65) Prior Publication Data

US 2009/0269975 A1 Oct. 29, 2009

(30) Foreign Application Priority Data

| | | |
|---|---|---|
| Apr. 28, 2008 | (JP) | 2008-117658 |
| Jul. 22, 2008 | (JP) | 2008-189037 |
| Nov. 21, 2008 | (JP) | 2008-298482 |
| Jan. 9, 2009 | (JP) | 2009-003545 |

(51) Int. Cl.
*H01R 29/00* (2006.01)

(52) U.S. Cl. ..... 439/188; 200/51.1

(58) Field of Classification Search ..... 439/188; 200/51.1

See application file for complete search history.

(56) References Cited

U.S. PATENT DOCUMENTS

| | | | | |
|---|---|---|---|---|
| 5,064,973 | A * | 11/1991 | Zinn et al. | 200/51.1 |
| 5,266,043 | A * | 11/1993 | Giroux et al. | 439/188 |
| 5,273,448 | A * | 12/1993 | Myer et al. | 439/188 |
| 5,505,631 | A | 4/1996 | Schauer et al. | |
| 5,674,084 | A * | 10/1997 | Fukamachi | 439/188 |
| 5,897,389 | A * | 4/1999 | Dietz et al. | 439/188 |
| 6,257,910 | B1 | 7/2001 | Mramor | |
| 6,764,324 | B2 | 7/2004 | Shinozaki et al. | |
| 6,786,747 | B1 | 9/2004 | Kamath | |
| 7,351,084 | B2 * | 4/2008 | Ohtaka et al. | 439/188 |
| 7,497,708 | B2 * | 3/2009 | Geismayr et al. | 439/188 |

FOREIGN PATENT DOCUMENTS

| | | |
|---|---|---|
| DE | 4428323 | 2/1995 |
| DE | 19702373 | 8/1998 |
| EP | 0389779 | 10/1990 |
| JP | 2007-258012 | 10/2007 |

* cited by examiner

*Primary Examiner*—Tho D Ta
(74) *Attorney, Agent, or Firm*—Gerald E. Hespos; Michael J. Porco

(57) ABSTRACT

A shorting terminal (40) includes a contact pieces (41) to be respectively brought into contact with a pair of laterally adjacent female terminal fittings (20) out of a plurality of female terminal fittings (20) arranged in vertical and lateral directions in an auxiliary connector (11), thereby shorting the pair of female terminal fittings (20), wherein releasing ribs (35) thrust themselves between the contact pieces (41) and the female terminal fittings (20) held in contact to release the pair of female terminal fittings (20). The both contact pieces (41) are arranged between the pair of laterally adjacent female terminal fittings (20).

10 Claims, 46 Drawing Sheets

SHORTING TERMINAL, CONNECTOR AND SHORTING METHOD

BACKGROUND OF THE INVENTION

1. Field of the Invention

The invention relates to a shorting terminal and a connector.

2. Description of the Related Art

U.S. Pat. No. 6,764,324 and FIGS. 23 and 24 herein show a connector with a shorting terminal. This known connector has three auxiliary connectors arranged laterally in a holder. One of the auxiliary connectors is illustrated in FIG. 23 and is identified by the numeral 1. The auxiliary connector 1 has cavities 2 that can accommodate terminal fittings (not shown). The cavities 2 are arranged laterally in eight columns at each of three vertical levels. The auxiliary connector 1 and the two other auxiliary connectors in the holder can be fit into a fitting recess 4 of a circuit board connector shown in FIG. 24.

Male tabs 5 project from the back wall of the fitting recess 4 and are arranged to correspond with the arrangement of the terminal fittings in the auxiliary connectors. Releasing ribs 6 also project from the back wall of the fitting recess 4. Each releasing rib 6 is arranged below a corresponding pair of laterally adjacent male tabs 5. Thus, thirteen releasing ribs 6 are arranged in conformity with the twenty-four male tabs 5 in the upper level, and eight are arranged in conformity with the sixteen male tabs 5 in the middle level.

On the other hand, terminal accommodating portions 3 are arranged in the auxiliary connector 1, as shown in FIG. 23, and are capable of accommodating shorting terminals (not shown). Each terminal accommodating portion 3 is arranged below a corresponding pair of laterally adjacent cavities 2 in the upper and middle levels of the auxiliary connector 1. Entrance holes 3A are formed in a connection surface of the auxiliary connector 1 for permitting the releasing ribs 6 to enter the terminal accommodating portions 3 when connecting the two connectors.

Although not shown, each shorting terminal has two contact pieces that are resiliently deformable in vertical directions. The contact pieces can contact and short the terminal fittings in two lateral adjacent cavities 2. The shorting terminals are not mounted in all the terminal accommodating portions 3, but rather are mounted only in the terminal accommodating portions 3 corresponding to the releasing ribs 6 of the male connector.

The releasing ribs 6 enter the terminal accommodating portions 3 through the entrance holes 3A as the two connectors are connected and thrust themselves between the terminal fittings and the contact pieces for releasing the shorted state.

A demand exists for smaller connectors. Accordingly, thought has been given to reducing dimensions of the above-described connector by reducing the number of the vertical levels that have shorting terminals or by reducing the number of laterally arranged columns that have shorting terminals. The required shorting terminals first are allotted successively to available positions at a first level. A second level is used if the required number of shorting terminals exceeds the number that can be arranged at the first level. The additional shorting terminals then are arranged successively at this second level. The shorting terminals may not necessarily be arranged at all the possible positions at the second level. Nevertheless, the second level is required even if only one shorting terminal is required for the second level. Thus, useless empty space is present in areas at the second level with no shorting terminal.

This empty space is illustrated in FIG. 23. Specifically, four terminal accommodating portions 3 are arranged at the second level, but only three terminal accommodating portions 3 actually are used at the three positions corresponding to the releasing ribs 6 shown in FIG. 24 (i.e. no releasing rib 6 is provided in the fourth terminal accommodating portion 3 from left). Thus, the remaining one terminal accommodating portion 3 becomes an empty space.

An attempt also could be made to reduce empty spaces by reducing the number of the lateral columns in which the shorting terminals are arranged rather than reducing the number of the vertical levels at which the shorting terminals are arranged. However, a reduction in the number of the lateral columns invariably means an increase in the number of the vertical levels, but this may be advisable to reduce the number of empty spaces. As a result, useless empty spaces may be reduced to miniaturize the connector.

A shorter releasing rib is less likely to break, but requires the contact points to be as close to the front of the contact pieces as possible. To this end, it is rational for the contact pieces to extend forward from supports to the contact points, as shown, for example, in Japanese Unexamined Patent Publication No. 2007-258012. Contact pieces of this shorting terminal have guiding surfaces extending forward from contact points to guide releasing ribs.

An attempt could be made to reduce the spring elasticity of the contact pieces in the construction described above by increasing distances from the supporting points to the contact points. As a countermeasure, it is thought to shorten the contact pieces in forward and backward directions by making an angle of inclination of the guiding surfaces steeper. However, it becomes difficult for the releasing ribs to slide properly in contact with a steep guiding surface and the guiding surfaces and the contact pieces are more likely to buckle. Thus, it is difficult to reduce the spring elasticity of the contact pieces and also to shorten the contact pieces.

The invention was developed in view of the above situations and an object is to miniaturize a connector.

Another object thereof is to reduce the spring elasticity of contact pieces and shorten the contact pieces.

SUMMARY OF THE INVENTION

The invention is directed to a shorting terminal with contact pieces that can be brought respectively into shorting contact with two laterally adjacent terminal fittings out of a plurality of terminal fittings arranged in vertical and lateral directions in a housing. At least one releasing rib thrusts itself between at least one of the contact pieces and at least one of the terminal fittings to release the shorted state. The contact pieces are arranged between the two laterally adjacent terminal fittings.

The invention also is directed to a connector that has a housing and terminal fittings arranged in vertical and lateral directions in the housing. The connector also has a shorting terminal with two contact pieces that can be brought respectively into contact with two laterally adjacent terminal fittings for shorting the terminal fittings. At least one releasing rib can thrust itself between at last one of the contact pieces and the corresponding terminal fitting to release the shorting of. The contact pieces are arranged between the laterally adjacent terminal fittings.

The number of vertical levels at which shorting terminals can be arranged can be increased. Accordingly, the connector can be miniaturized by reducing the number of empty spaces.

The contact pieces may be arranged to laterally face each other, and the leading ends of the contact pieces may be folded inwardly and displaced in forward and backward directions. Thus, the leading ends of the contact pieces can be brought closer without interfering with each other. Hence, an interval between the laterally adjacent terminal fittings can be narrowed and a lateral dimension of the connector can be reduced.

The contact pieces may be arranged in an entrance path for the releasing rib and vertically displaced to move to a position retracted from the entrance path for the releasing rib by sliding in contact with the releasing rib. Accordingly, the contact pieces can be displaced vertically by one releasing rib. The releasing rib can be thicker and more rigid as compared with the case where releasing ribs are provided separately the both contact pieces.

The releasing rib is thrust between the terminal fitting and only one of a pair of contact pieces to release the shorting of the pair of terminal fittings. Therefore, the one contact piece may be shaped so that stress from the releasing rib is difficult to concentrate. More particularly, the one contact piece is deformed resiliently by receiving the stress from the releasing rib that is thrust between the one contact piece and the terminal fitting and the one contact piece is shaped so that stress is difficult to concentrate upon receiving the stress from the releasing rib. Hence, the contact pieces need not be formed from a material with good springiness.

The first and second contact pieces may define a substantially V- or U-shape, and a joint connecting the base ends of the contact pieces may be closer to the terminal fitting held in contact with the first contact piece than to the terminal fitting held in contact with the second contact piece. Thus, the second contact piece can be moderately arcuate from the joint toward the leading end thereof since the joint is closer to the terminal fitting held in contact with the first contact piece. Thus, stress can be distributed in this moderately arcuate part.

A distance from a joint connecting the base ends of both contact pieces to the leading end of the second contact piece may be longer than that from the joint to the leading end of the first contact piece. Accordingly, since the second contact piece is longer than the first contact piece, a displacement amount of the joint is suppressed in the case of resiliently deforming the second contact piece than in the case of resiliently deforming the first contact piece by the releasing rib.

The shorting terminal may include a supporting base for retaining both contact pieces in the housing by supporting a connecting portion that connects the base ends of both contact pieces with each other and is fixed in the housing between the pair of laterally adjacent terminal fittings. Thus, the shorting terminal can be retained in the housing by the supporting base.

The invention also relates to a shorting terminal to be arranged between two adjacent terminal fittings for shorting the two terminal fittings. The shorting terminal has first and second contact pieces for contacting two terminal fittings. The first contact piece extends forward from a first support to a second support, is folded out at the second support to extend back toward a contact point and is folded in at the contact point to extend back. Thus, the first contact piece is resiliently deformable at two supporting points. At least one releasing rib can be thrust between the contact point and the corresponding terminal fitting for releasing the two terminal fittings. A resilient force of the second supporting point is set smaller than that of the first supporting point.

A guiding surface for the releasing rib is defined between the second support and the contact point. Engagement of the releasing rib with the guiding surface deforms the second support earlier than the first supporting point because the resilient force of the second support is smaller than that of the first supporting point. Thus, an angle of inclination of the guiding surface becomes more moderate and the releasing rib will not buckle the contact piece. The length of the guiding surface in forward and backward directions is shortened since the inclination of the guiding surface can be steeper while the buckling of the contact piece is prevented.

Thereafter, the releasing rib slides on the guiding surface and moves between the contact point and the terminal fitting to release the shorting of the two terminal fittings. The force exerted by the releasing rib on the contact point is transmitted to the second support and the first support is deformed resiliently with the second support as a point of force application. A distance from the first support to the second support is longer than that from the first support to the contact point. Thus, the first support can support the contact piece with a force smaller than the force the contact point receives from the releasing rib and the spring elasticity of the contact piece can be reduced.

The shorting terminal may comprise a bottom wall, a rear wall projecting from a rear edge of the bottom wall and two side walls supporting the corresponding contact pieces. The side walls may project from opposite lateral edges of the bottom wall while facing each other, and the rear wall may be arranged between the opposite side walls. Thus, the rear wall supports the opposite side walls and prevents the side walls from being inclined inwardly.

The invention also relates to a connector with a housing, a plurality of terminal fittings arranged in vertical and lateral directions in the housing, and at least one of the above shorting terminals. The contact pieces of the shorting terminal are arranged between two laterally adjacent terminal fittings. Thus, the shorting terminal is arranged efficiently and the housing can be miniaturized.

The housing may include at least one entrance hole for permitting entry of the releasing rib from the front. The housing may also include a terminal accommodating portion that communicates with the interior of the entrance hole and adapted to accommodate the shorting terminal inserted therein from behind. The second support may be arranged in the terminal accommodating portion to avoid an entrance path for the releasing rib.

The shorting terminal may be inserted into the terminal accommodating portion with the both contact pieces kept close to each other, and the one contact piece may be bent so as not to touch the other contact piece. Thus, the contact pieces will not interfere with one another.

According to the invention, the connector can be miniaturized by reducing the number of empty spaces.

These and other objects, features and advantages of the invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

A lever-type connector in accordance with the invention is illustrated in FIGS. 1 to 8 female and male connectors 10 and 30 that are connectable by rotating a lever (not shown). In the following description, end of the connectors 10, 30 to be connected are referred to as front ends concerning forward and backward directions.

Figure 8:
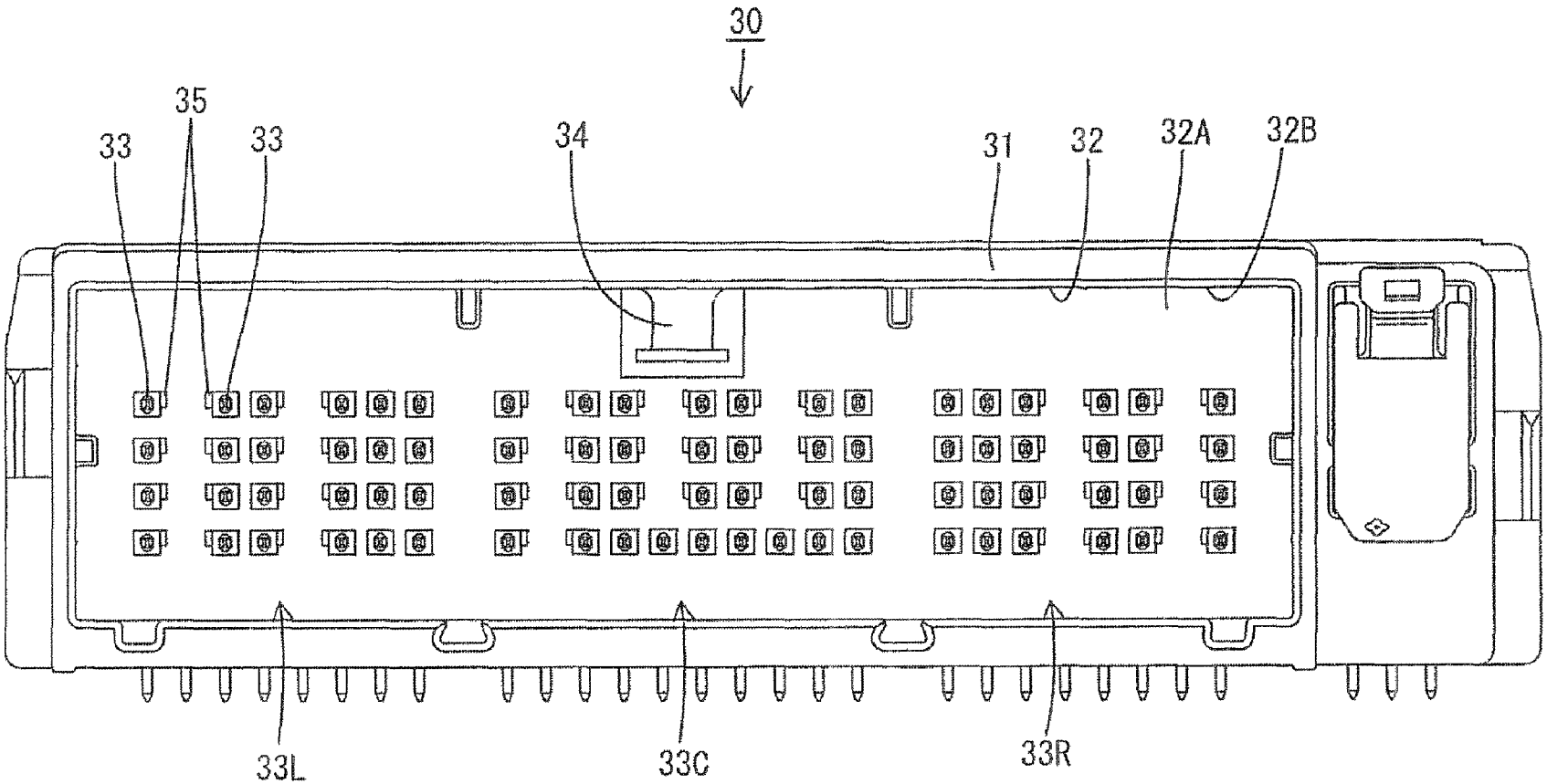
FIG. 8 is a front view of a male connector.

As shown in FIG. 8, the male connector 30 is a circuit board connector and includes a male housing 31 made e.g. of synthetic resin. The male housing 31 includes a wide rectangular receptacle 32 with an open front end, and the female connector 10 can fit into the receptacle 32. At least one substantially cylindrical cam pin 34 projects down and into the interior of the receptacle 32 from the upper wall 32B of the receptacle 32.

Tab-shaped male terminal fittings 33 project forward from a back wall 32A of the receptacle 32. As shown in FIG. 8, a left male terminal fitting group 33L has male terminal fittings 33 arrayed in a first matrix of six columns at four levels, a central male terminal fitting group 33C has male terminal fittings 33 arrayed in a second matrix of seven columns at four vertical levels and a right male terminal fitting group 33R has male terminal fittings 33 arrayed in a third matrix arranged in six columns at four vertical levels. Thus, a total of seventy eight male terminal fittings 33 are arranged.

The left male terminal fitting group 33L has two laterally adjacent male terminal fittings 33 in the first and second columns from the left that form a set and two laterally adjacent male terminal fittings 33 in the third and fourth columns from the left that form a set. Pairs of substantially rectangular releasing ribs 35 project forward from the back wall 32A along a connecting direction with the female connector and extend between each pair of laterally adjacent male terminal fittings 33. The releasing ribs 35 in each pair are arranged to face each other and are arranged lateral to the pair of male terminal fittings 33.

The right male terminal fitting group 33R has two laterally adjacent male terminal fittings 33 in the first and second columns from the right that form a set and two laterally adjacent male terminal fittings 33 in the third and fourth columns from the right that form a set. Two releasing ribs 35 are provided between each pair of laterally adjacent male terminal fittings 33 in the right male terminal fitting group 33R, similar to the left male terminal fitting group 33L.

The central male terminal fitting group 33C has two laterally adjacent male terminal fittings 33 in the first and second columns from the left that form one set, two laterally adjacent male terminal fittings 33 in the third and fourth columns from left form one set and two laterally adjacent male terminal fittings 33 in the fifth and sixth columns from left form one set. Two releasing ribs 35 are provided between each pair of laterally adjacent male terminal fittings 33 in the central male terminal fitting group 33C. One male terminal fitting 33 is arranged between the third and fourth columns from the left at the fourth level from above instead of a pair of releasing ribs 35, and one terminal fitting 33 is arranged between the fifth and sixth columns from the left at the fourth level from above instead of a pair of releasing ribs 35.

Figure 1:
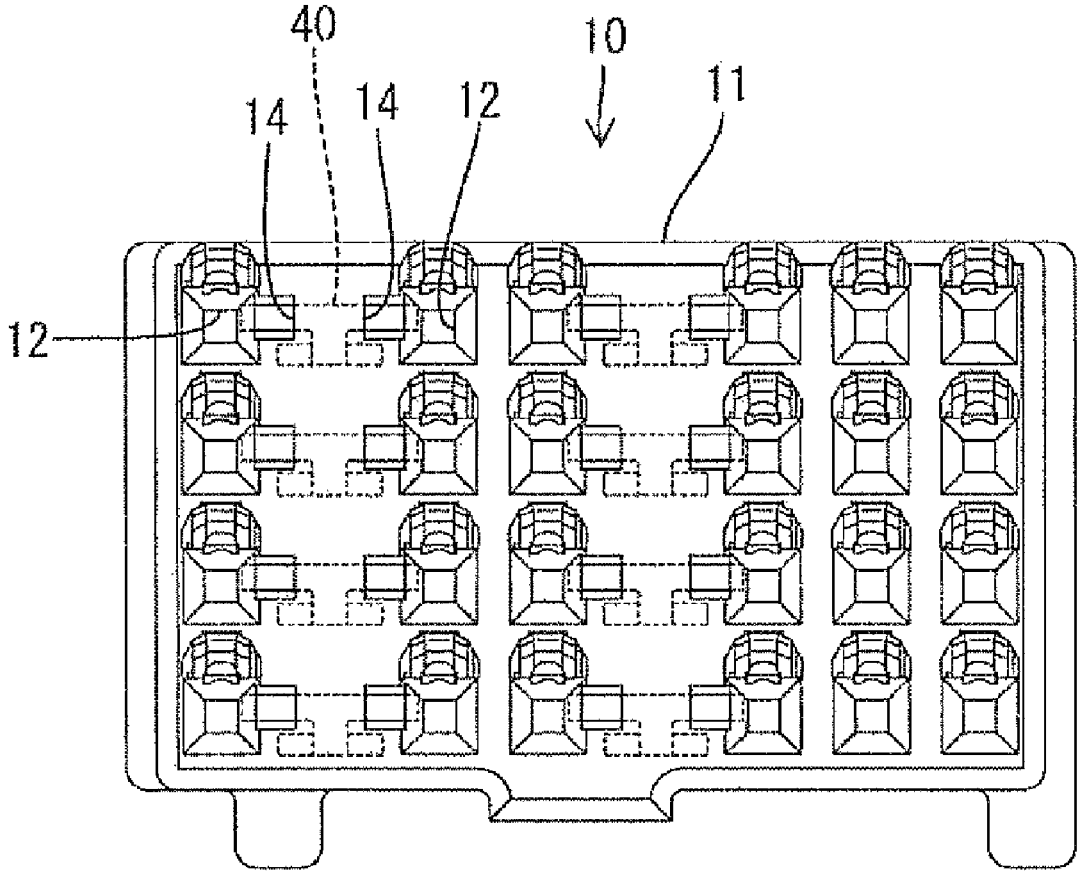
FIG. 1 is a front view showing a state where shorting terminals are mounted in an auxiliary connector according to a first embodiment.

The female connector 10 has the auxiliary connector 11 shown in FIG. 1, at least one auxiliary connector (not shown) laterally symmetrical to this auxiliary connector 11, at least one auxiliary connector (not shown) including a different number of female terminal fittings 20 from the auxiliary connector 11 and a wide rectangular frame-like holder (not shown) for accommodating these three auxiliary connectors 11. The holder is made e.g. of a synthetic resin and is substantially hollow in forward and backward directions. An accommodation recess is provided in the holder for accommodating a lever. In this embodiment, the term "housing" refers to the assembly of the three auxiliary connectors 11 and the holder.

In the following description, the auxiliary connector 11 is described as a representative of the three auxiliary connectors. The other two auxiliary connectors are substantially similar to the auxiliary connector 11 and are not described. The auxiliary connector 11 is made e.g. of a synthetic resin and is substantially in the form of a rectangular block. Cavities 12 penetrate the auxiliary connector 11 in forward and backward directions and female terminal fittings 20 are inserted into the respective cavities 12 from behind. Wires W are fixed to the female terminal fittings 20 and are drawn out backward from the rear surface of the auxiliary connector 11.

The auxiliary connector 11 is assembled by being fit into the holder from behind and is retained in the holder by unillustrated retaining means. In an assembled state, the front and rear surfaces of the auxiliary connector 11 are flush with those of the holder.

The female terminal fittings 20 that have been inserted into the cavities 12 correspond to the male terminal fittings 33 of the male connector 10. Thus, the female terminal fittings 20 are arranged in nineteen columns and at four vertical levels when all of the auxiliary connectors 11 are assembled in the holder.

The lever is made e.g. of a synthetic resin and is supported rotatably in the lever accommodation space in the holder. More particularly, the lever has at least one cam groove (not shown) that is engageable with the at least one cam pin 34 at the time of connecting the two connectors 10, 30. The cam pin 34 is inserted into the entrance of the cam groove at the start of a connecting operation. The lever then is operated rotated so that the outer circumferential surface of the cam pin 34 and the inner wall of the cam groove engage to exhibit a cam action that urges the two connectors 10, 30 toward a properly connected state.

Two laterally adjacent cavities 12 in a pair of columns (e.g. the first and second columns from left) form one set and two laterally adjacent cavities 12 in an adjacent pair of columns (e.g. the third and fourth columns from left) form one set. A terminal accommodating potion 13 is arranged between each of these pairs of laterally adjacent cavities 12 and can accommodate the shorting terminal 40 from behind.

Entrance holes 14 are formed in the front surface of the auxiliary connector 11 and permit communication between the insides and outsides of the respective terminal accommodating portion 13. The entrance holes 14 are arranged in conformity with the one or more releasing ribs 35 of the male connector 30, so that the releasing ribs 35 are inserted through the entrance holes 14 and into the terminal accommodating portions 13 as the two connectors 10, 30 are connected.

Figure 5:
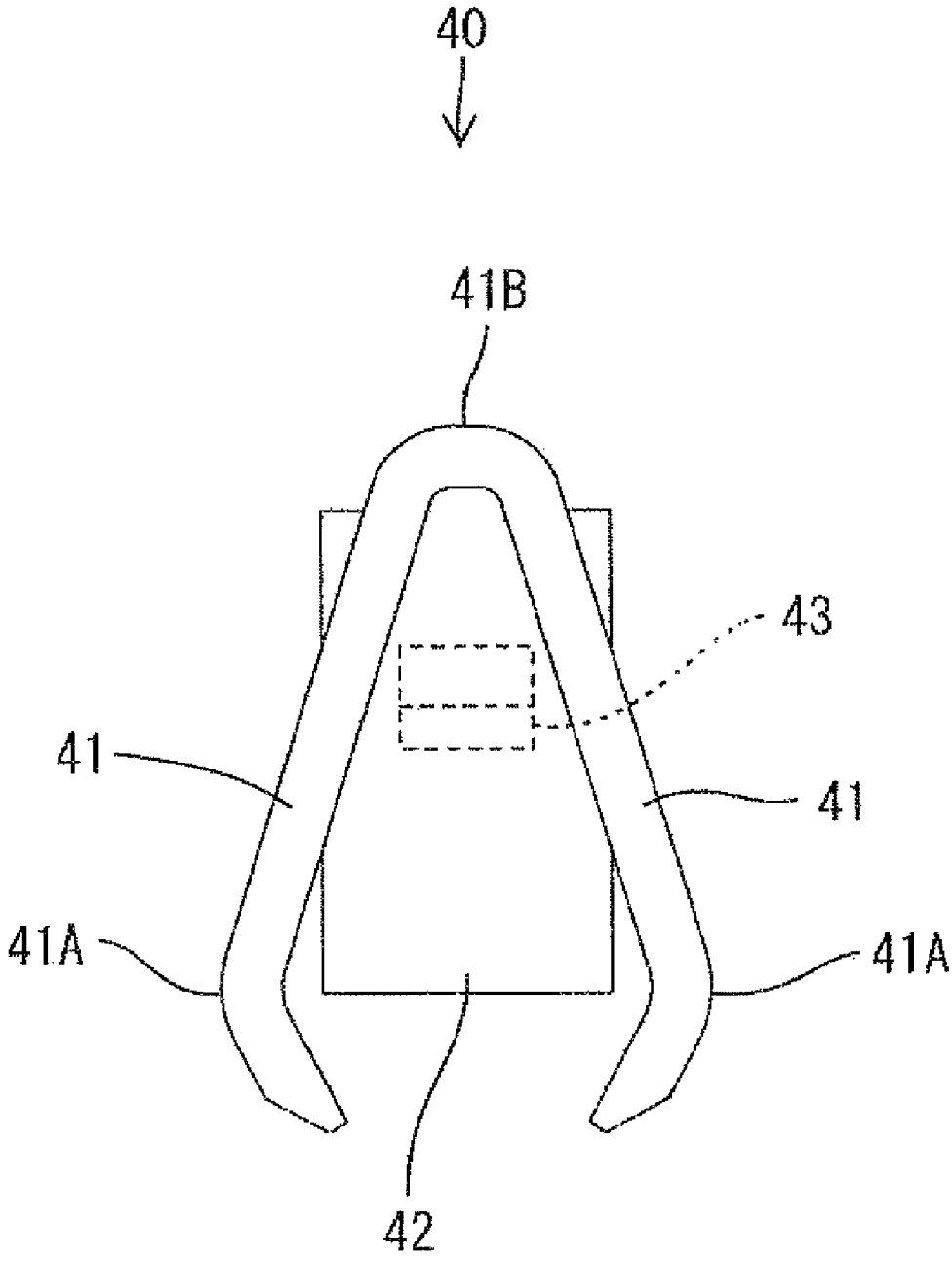
FIG. 5 is a plan view of the shorting terminal.

Each shorting terminal 40 is made of a conductive material, such as metal, and includes two contact pieces 41 arranged to face each other and a supporting base 42 for supporting a connecting portion 41B that connects the base ends of the contact pieces 41, as shown in FIG. 5. Leading ends of the contact pieces 41 are bent slightly inward to have a substantially mountain shape. Outer tip portions of the bent parts define contact points 41A with the female terminal fittings 20.

Figure 6:
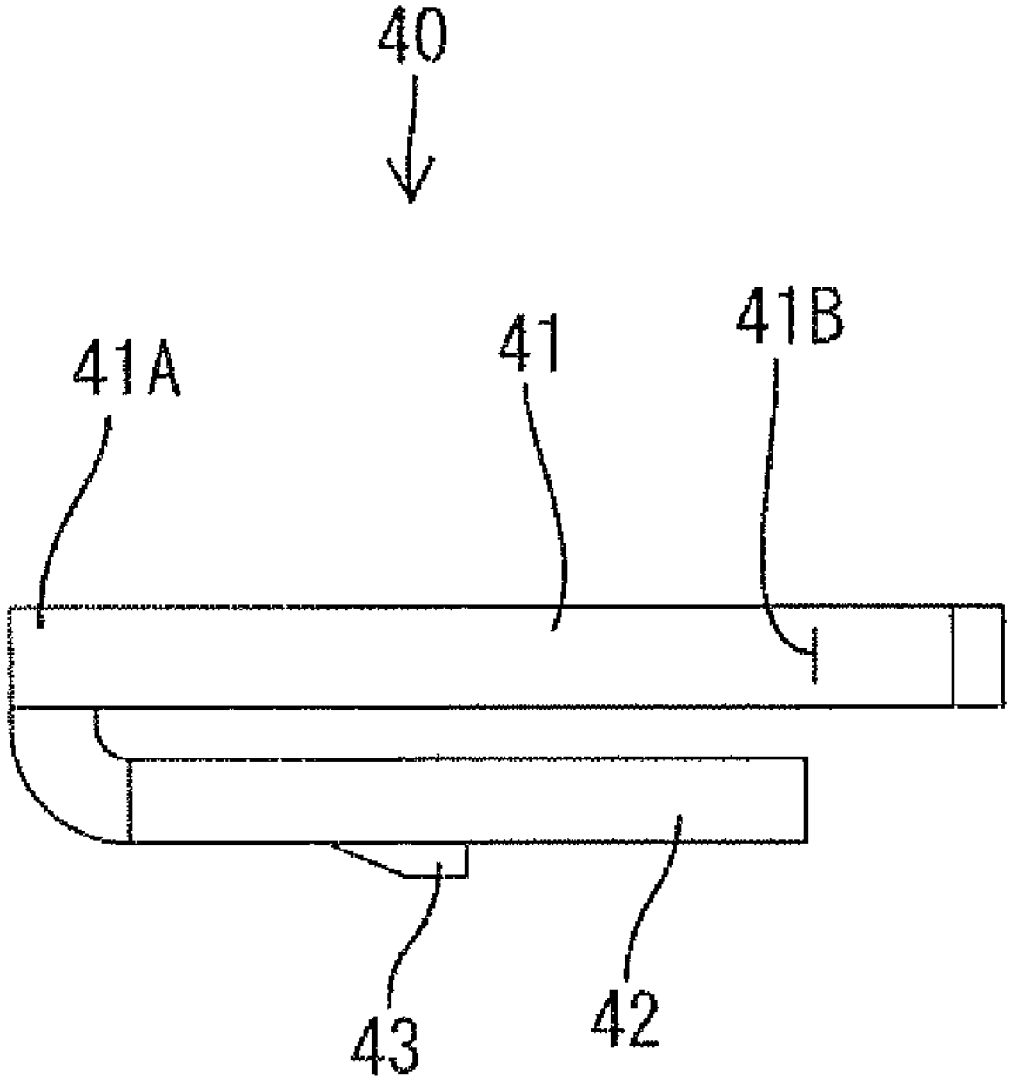
FIG. 6 is a side view of the shorting terminal.
Figure 7:
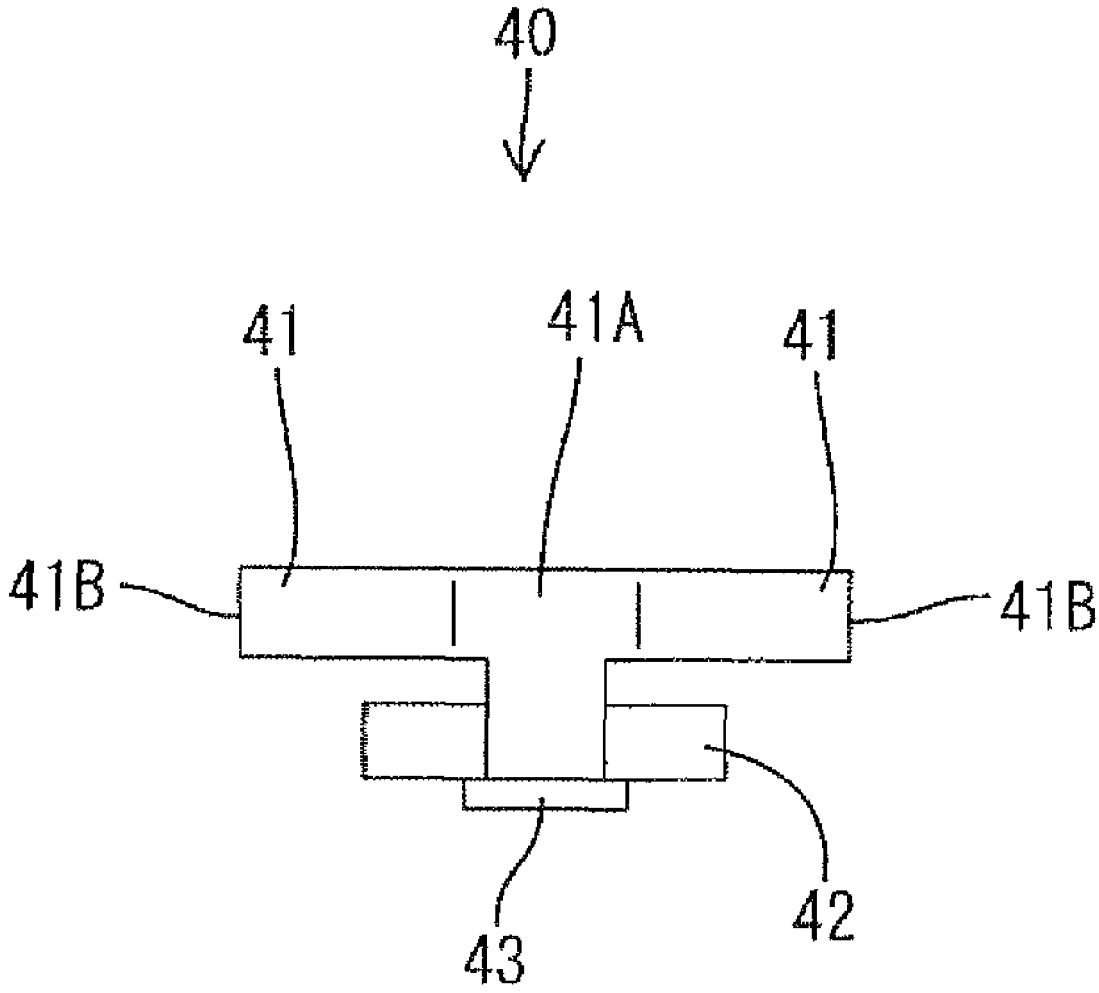
FIG. 7 is a front view of the shorting terminal.

As shown in FIGS. 6 and 7, the supporting base 42 is arranged in a posture substantially parallel to the contact pieces 41. Further, a retaining piece 43 projects down from the lower surface of the supporting base 42 substantially normal to a plane containing the contact pieces 41 or longitudinal axes thereof. The terminal accommodating portion 13 has a first accommodating portion 13A for movably guiding the supporting base 42 in forward and backward directions and a second accommodating portion 13B for accommodating the contact pieces 41. The retaining piece 43 is engageable with a retaining projection (not shown) formed on the bottom surface of the first accommodating portion 13A. In this way, the engagement of the retaining piece 43 with the retaining projection retains shorting terminal 40 in the terminal accommodating portion 13.

Figure 2:
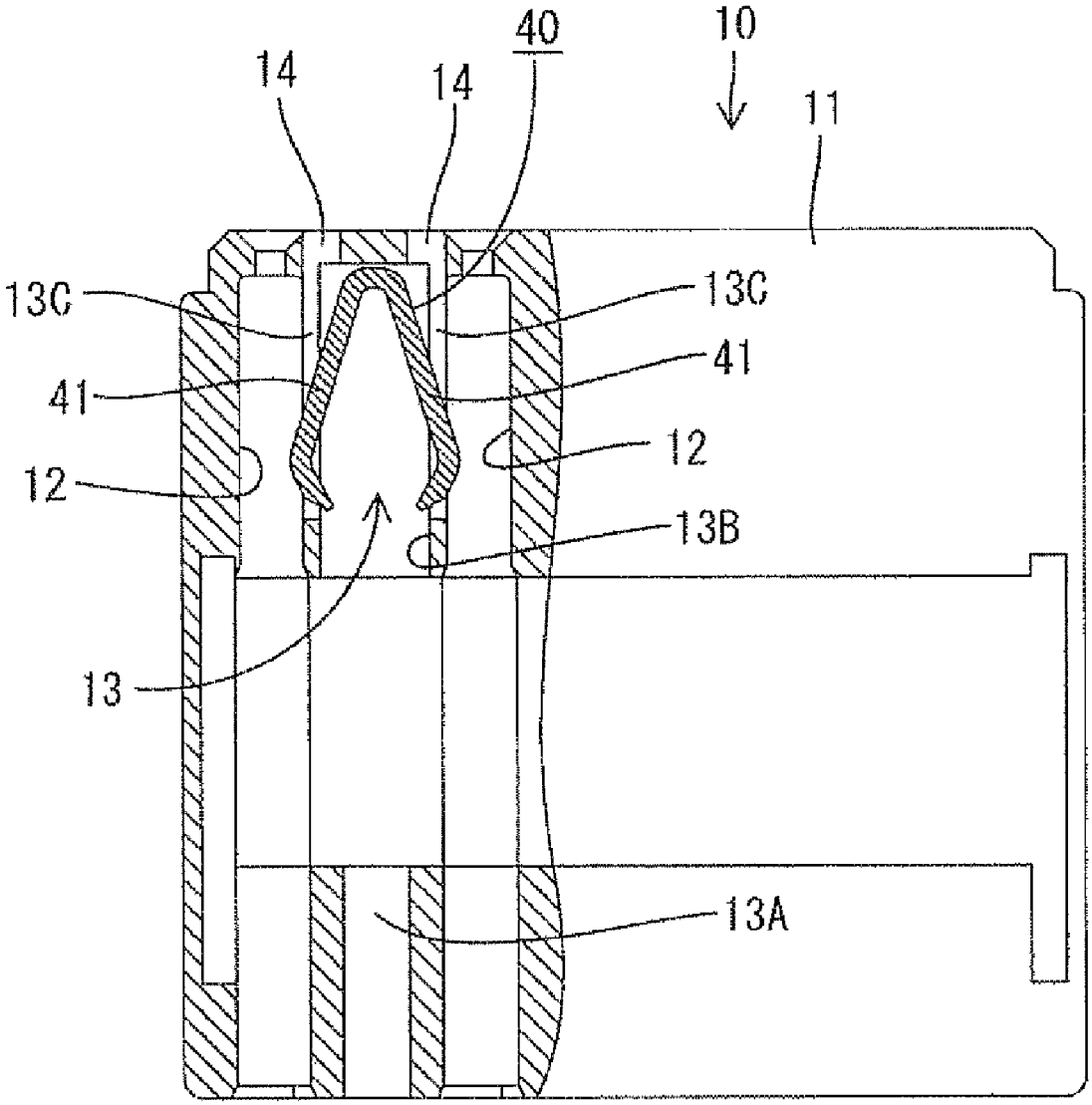
FIG. 2 is a plan view partly in section showing a state where the shorting terminal is mounted in the auxiliary connector.

Insertion holes 13C are formed in partition walls that partition the upper accommodating portion 13B of the terminal accommodating portion 13 and the cavities 12 for permitting communication of the interior of the upper accommodating portion 13B and the interiors of the cavities 12, as shown in FIG. 2. The contact points 41A of the contact pieces 41 are inserted in the cavities 12 through the insertion holes 13C unless the female terminal fittings 20 are accommodated in the cavities 12.

The contact pieces 41 slide on the female terminal fittings 20 and deform resiliently inwardly of the upper accommodating portion 13B when the female terminal fittings 20 are inserted into the cavities 12. Thus, the contact points 41A contact lateral portions of the female terminal fittings 20. In this state, a pair of vertically adjacent cavities 12 can be arranged closer to each other because the shorting terminal 40 is arranged between the laterally adjacent female terminal fittings 20. Therefore, the number of vertical levels at which the shorting terminals 40 can be arranged can be increased.

Figure 23:
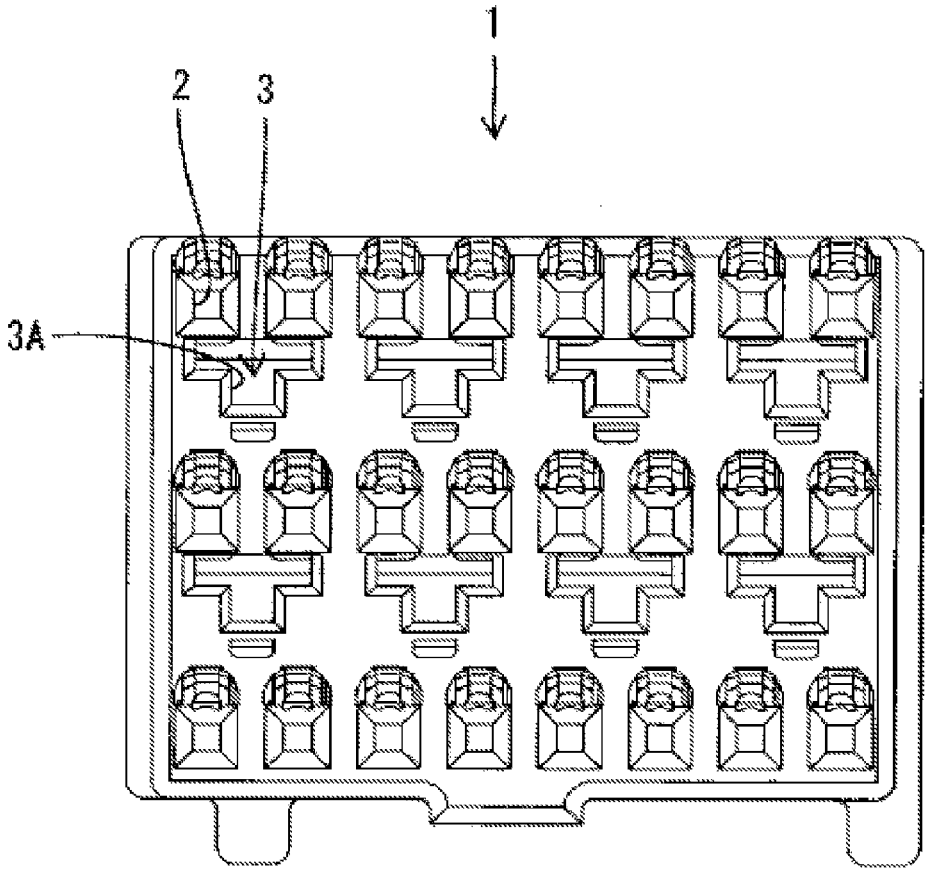
FIG. 23 is a front view of a conventional auxiliary connector.
Figure 24:
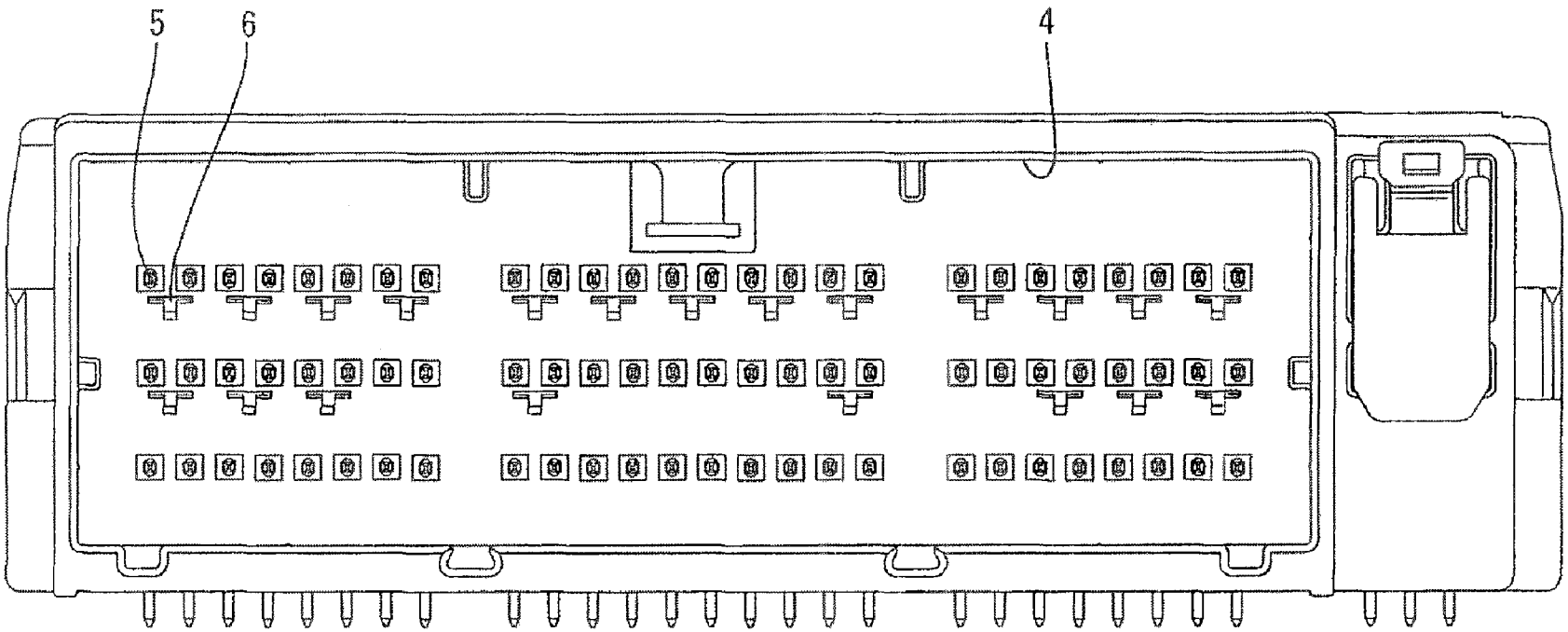
FIG. 24 is a front view of a conventional male connector.

The cavities 2 can be arranged at the four vertical levels shown in FIG. 1 rather than at the three vertical levels in the conventional auxiliary connector 1, shown in FIG. 23. In addition, the auxiliary connector 11 of this embodiment has a shorter vertical height than the conventional auxiliary connector 1 even though the number of the female terminal fittings 20 is equal to that in the conventional structure.

The insertion holes 13C are formed at positions corresponding to the entrance holes 14 and communicate with the entrance holes 14. Thus, the releasing ribs 35 are insertable into the insertion holes 13C through the entrance holes 14. Further, the releasing ribs 35 thrust themselves between the contact pieces 41 when being inserted into the insertion holes 13C and the female terminal fittings 20 held in contact as shown in FIG. 4, so that the laterally adjacent female terminal fittings 20 are released.

Figure 3:
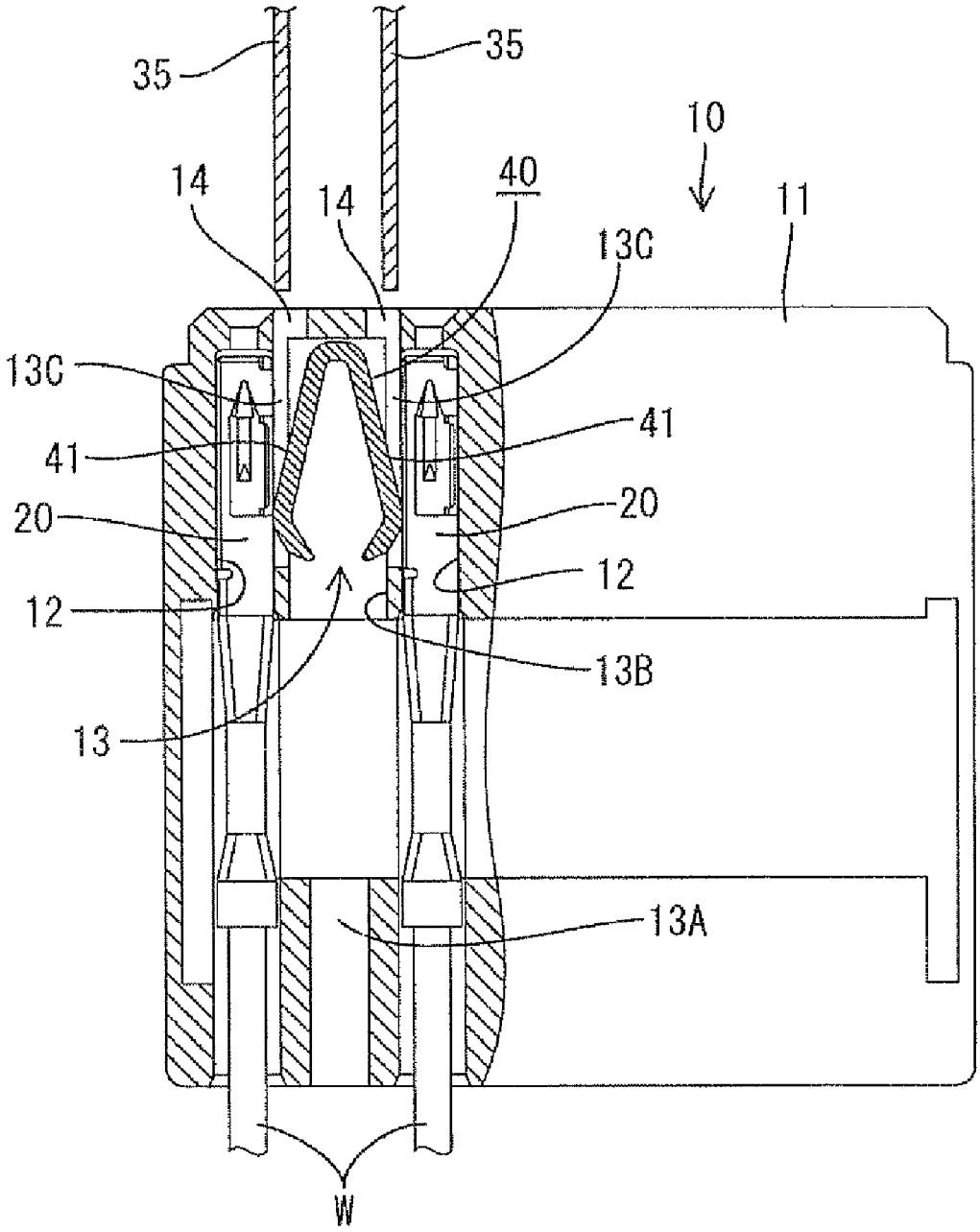
FIG. 3 is a plan view partly in section showing a state where female terminal fittings are mounted in the auxiliary connector.

The connector is assembled by inserting the female terminal fittings 20 into the respective cavities 12. The contact points 41A of the shorting terminal 40 project through the insertion holes 13C and into the cavities 12, as shown in FIG. 2. Thus, the contact pieces 41 are displaced toward each other as the female terminal fittings 20 are inserted. The contact pieces 41 are held in contact with the female terminal fittings 20 at the left and right sides when the female terminal fittings 20 reach proper insertion positions, as shown in FIG. 3. Thus, the laterally adjacent female terminal fittings 20 are shorted electrically by the shorting terminal 40.

The auxiliary connectors 11 then are assembled into the holder and the lever is set at a position so that the cam groove can receive the cam pin 34. The two connectors 10, 30 next are fit lightly together so that the cam pin 34 is inserted into the entrance of the cam groove. The lever then is rotated so that the cam action caused by the engagement of the cam pin 34 and the cam groove pulls the connectors 10, 30 together and inserts the holder inserted into the receptacle 32. The female and male terminal fittings 20, 33 are connected electrically when the two connectors 10, 30 are connected properly.

Figure 4:
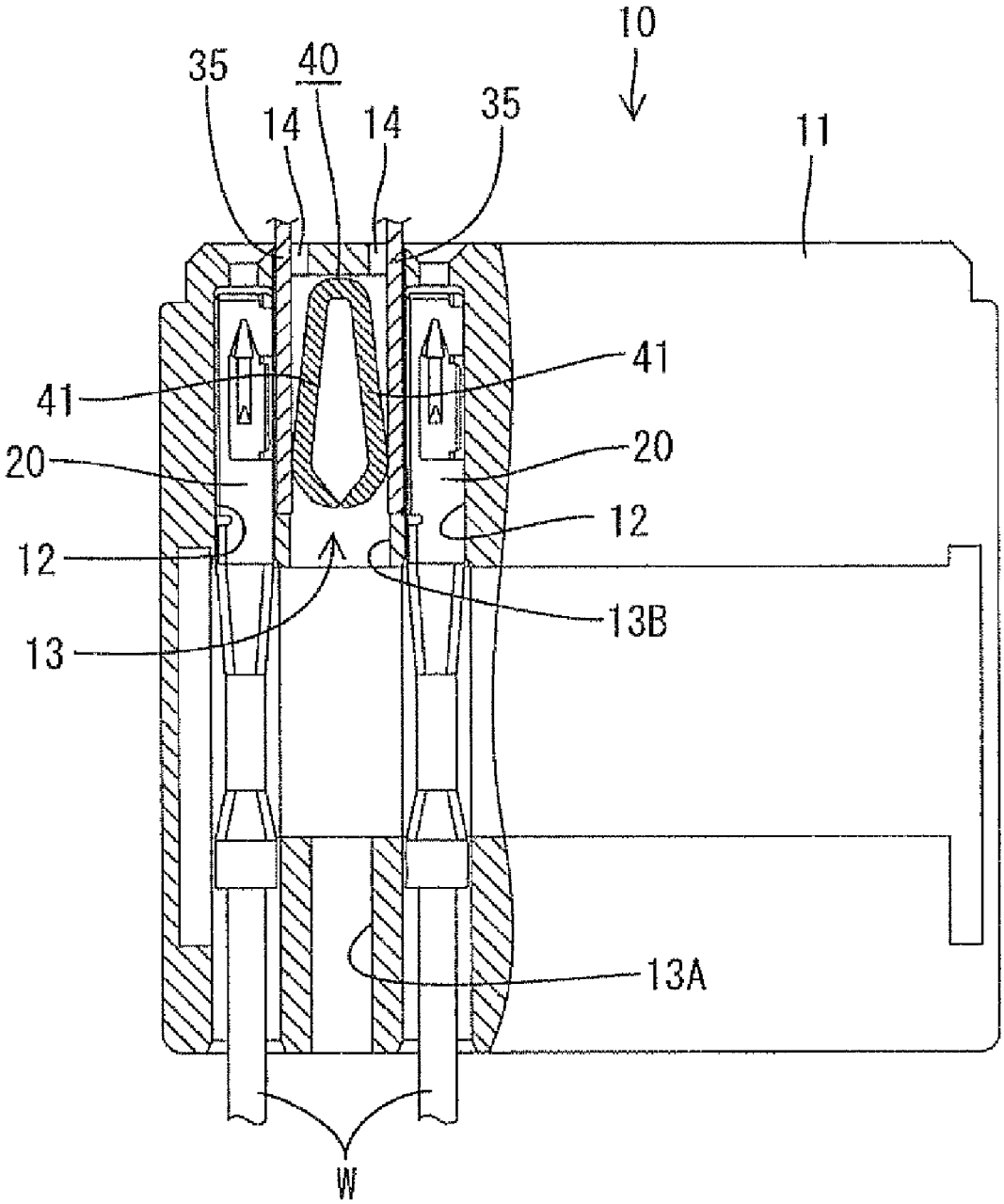
FIG. 4 is a plan view partly in section showing a state where releasing ribs are inserted in the auxiliary connector.

The releasing ribs 35 pass through the insertion holes and enter the upper accommodating portions 13B of the terminal accommodating portions 13 through the insertion holes 13C as the connectors 10, 30 are being connected and move between the engaged contact pieces 41 and the female terminal fittings 20, as shown in FIG. 4. In this way, the pairs of laterally adjacent female terminal fittings 20 are no longer in contact with the shorting terminals 40 and are released electrically.

Each shorting terminal 40 is arranged between the laterally adjacent female terminal fittings 20 in a pair of female terminal fittings 20. Thus, the number of the vertical levels can be increased. In this way, useless empty spaces are reduced to miniaturize the connector 10. Further, each shorting terminal 40 includes the supporting base 42 that is guided in forward and backward directions by the lower accommodating portion 13A of the terminal accommodating portion 13 and the retaining piece 43 engages the retaining projection to hold the contact pieces 41 in the upper accommodating portion 13B.

Figure 9:
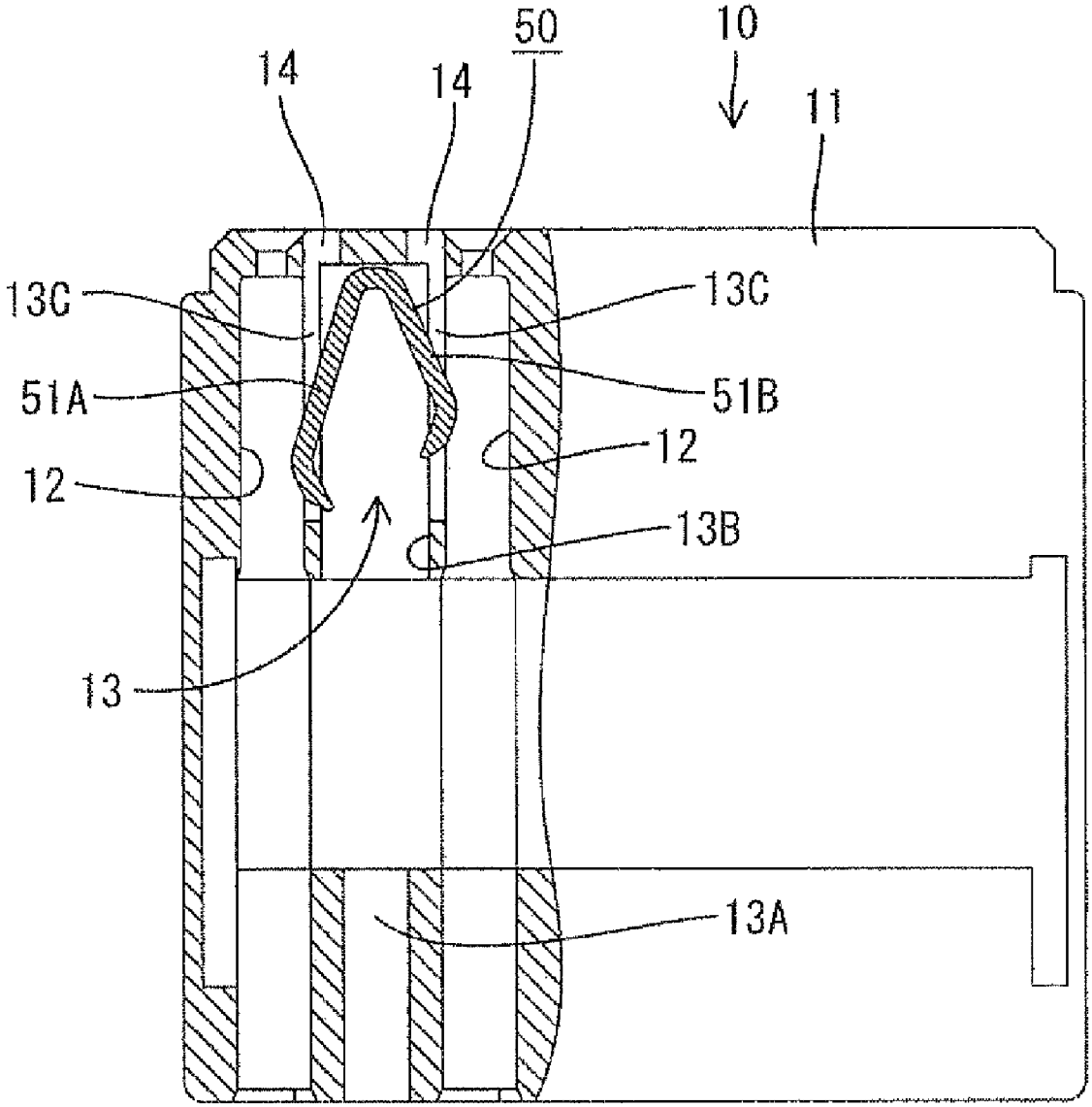
FIG. 9 is a plan view partly in section showing a state where a shorting terminal is mounted in an auxiliary connector according to a second embodiment.
Figure 10:
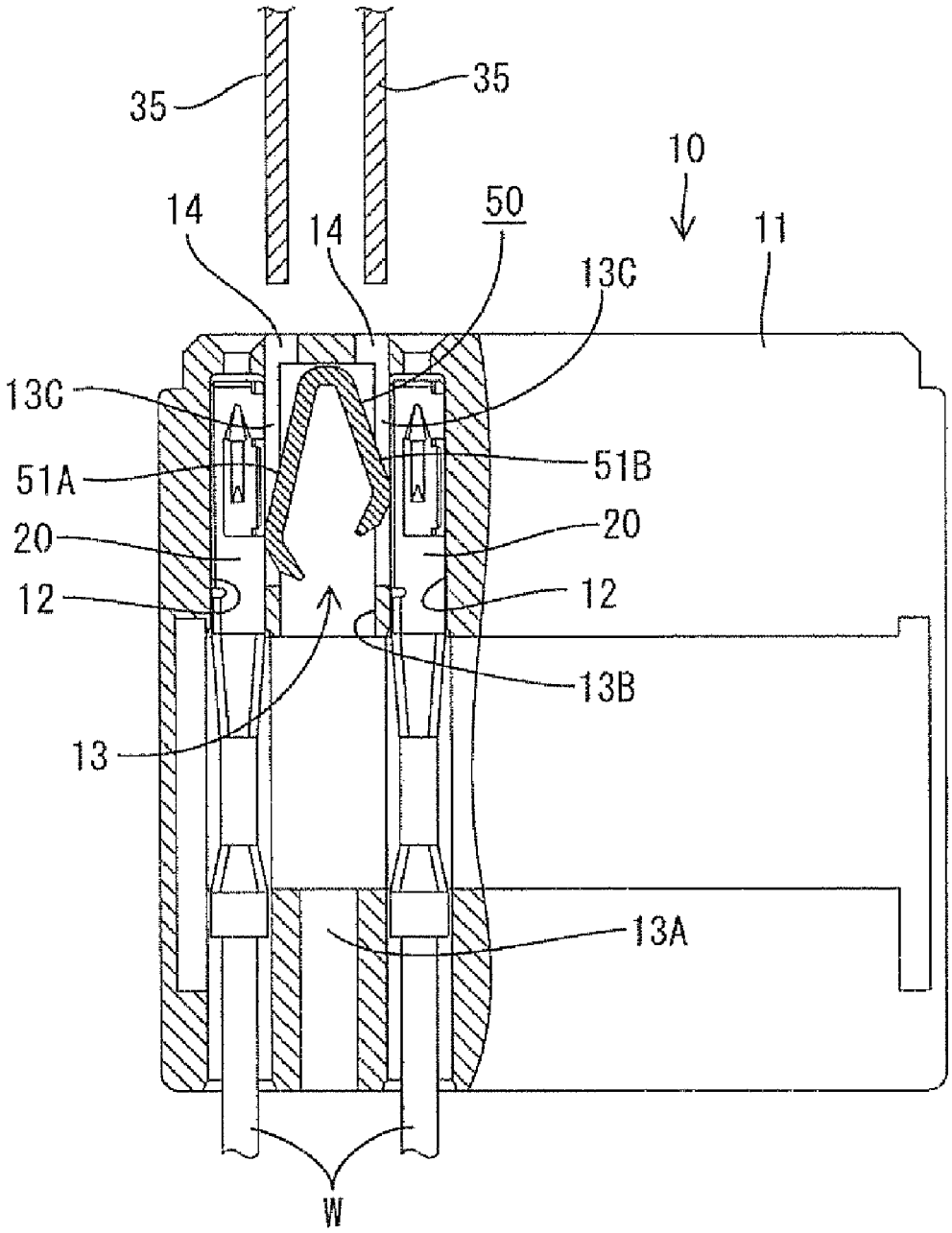
FIG. 10 is a plan view partly in section showing a state where female terminal fittings are mounted in the auxiliary connector.
Figure 11:
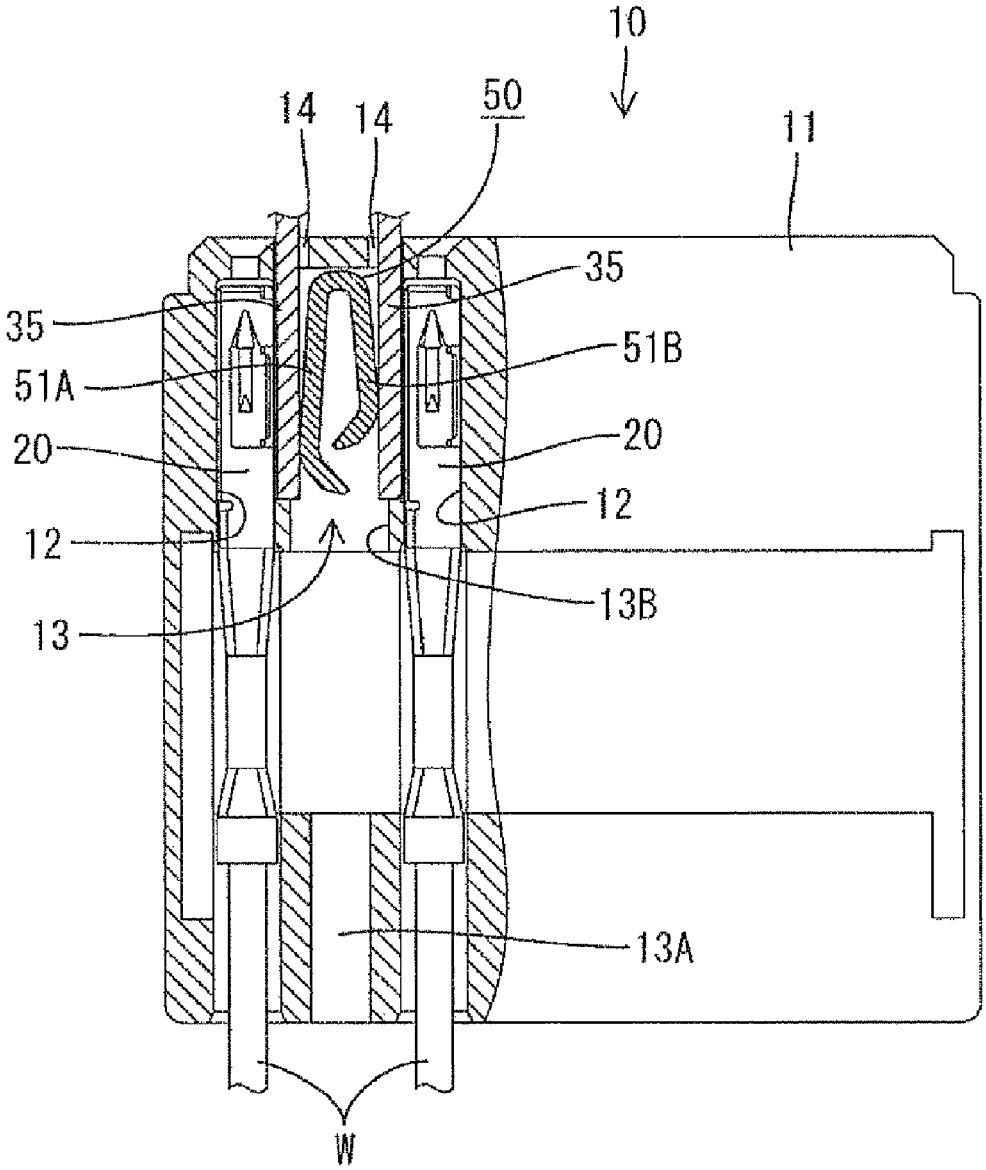
FIG. 11 is a plan view partly in section showing a state where a releasing rib is inserted in the auxiliary connector.

A shorting terminal in accordance with a second embodiment of the invention is identified by the numeral 50 in FIGS. 9 to 11. The shorting terminal 50 is obtained by partly changing the construction of the shorting terminal 40 of the first embodiment. Elements of the shorting terminal 50 that are the same as or similar to the shorting terminal 40 are identified by the same reference numerals, but are not described again.

The shorting terminal 50 has a left contact piece 51A and a right contact piece 51B with different longitudinal lengths, as shown in FIG. 9. The female terminal fittings 20 are inserted into the respective cavities 12, as shown in FIG. 10, and the releasing ribs 35 are inserted through the entrance holes 14 and into the insertion holes 13C for displacing the contact pieces 51A, 51B, as shown in FIG. 11. At this time, the leading end of the right contact piece 51B is at the inner side of a contact point of the left contact piece 51A and the leading ends of the right and left contact pieces 51B and 51A are offset in forward and backward directions to prevent mutual interference.

In other words, the contact pieces 51A, 51B can be displaced to positions closer to each other than in the first embodiment, and hence the pair of laterally adjacent female terminal fittings 20 can be arranged closer. Thus, the terminal accommodating portions 13 can be smaller in the lateral direction and the female connector 10 can be miniaturized in the lateral direction. On the other hand, a sufficient interval is ensured in the male connector 30 between the pairs of laterally adjacent releasing ribs 35 and the releasing ribs 35 can be arranged closer due to the miniaturization of the terminal accommodating portions 13. Therefore, the male connector 30 also can be miniaturized as the female connector 10 is miniaturized.

A third embodiment of the invention is described with reference to FIGS. 12 to 22. This embodiment is obtained by partly changing the constructions of the shorting terminals 40, the releasing ribs 35 and the terminal accommodating portions 13 of the first embodiment. Elements of the third embodiment that are the same as or similar to the first embodiment are identified by the same reference numerals, but are not described again.

Figure 20:
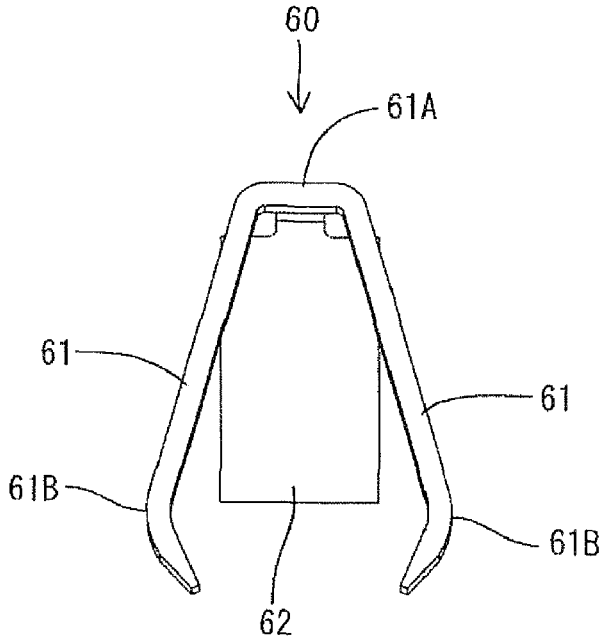
FIG. 20 is a plan view of the shorting terminal.
Figure 21:
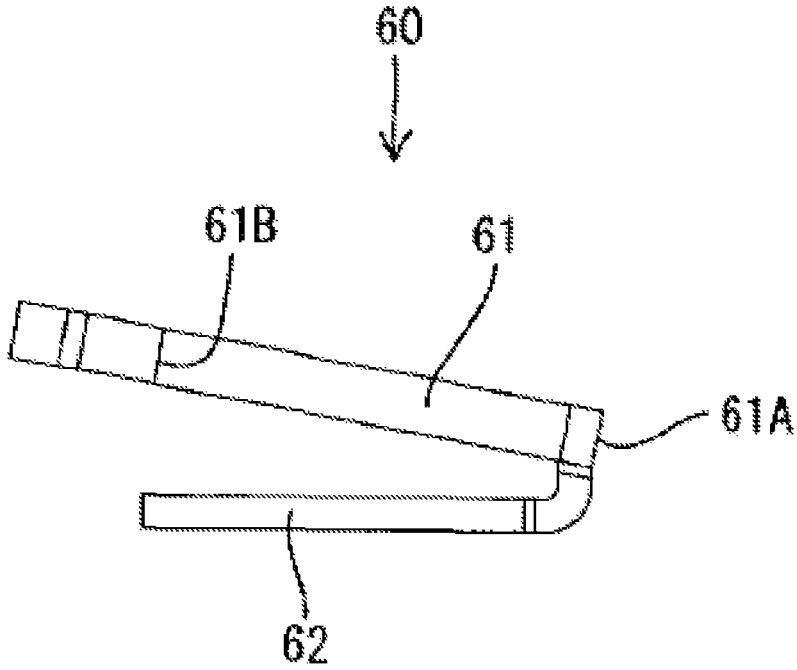
FIG. 21 is a side view of the shorting terminal.
Figure 22:
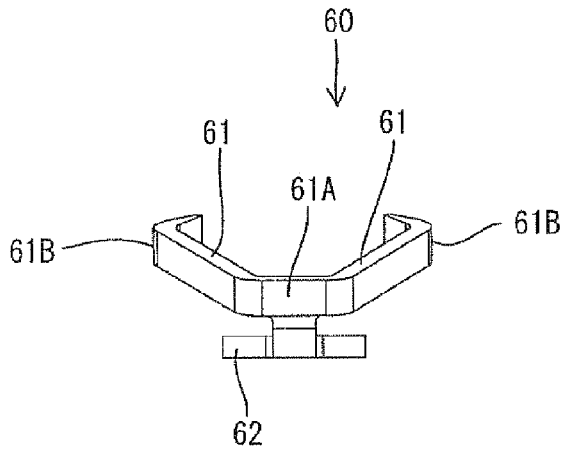
FIG. 22 is a front view of the shorting terminal.

A shorting terminal 60 of the third embodiment is substantially the same as in the first embodiment. More particularly, the shorting terminal 60 has two contact pieces 61 and the base ends of the contact pieces 61 are connected by a connecting portion 61A, as shown in FIGS. 20 to 22. However, the contact pieces 61 are arranged obliquely to be more distant from a supporting base 62 as they extend from the connecting portion 61A toward the leading ends. Further, the contact pieces 61 are vertically resiliently deformable with respect to the supporting base 62.

Each terminal accommodating portion 70 of the third embodiment has an upper accommodating portion 70A, a lower accommodating portion 70B and an inclined guide 70C that permits communication between the upper and lower accommodating portions 70A, 70B. The supporting base 62 of the shorting terminal 60 is to be fixed in the guide 70C by suitable fixing means, for example, by being pressed therein or engaged therewith although not shown in detail.

Figure 12:
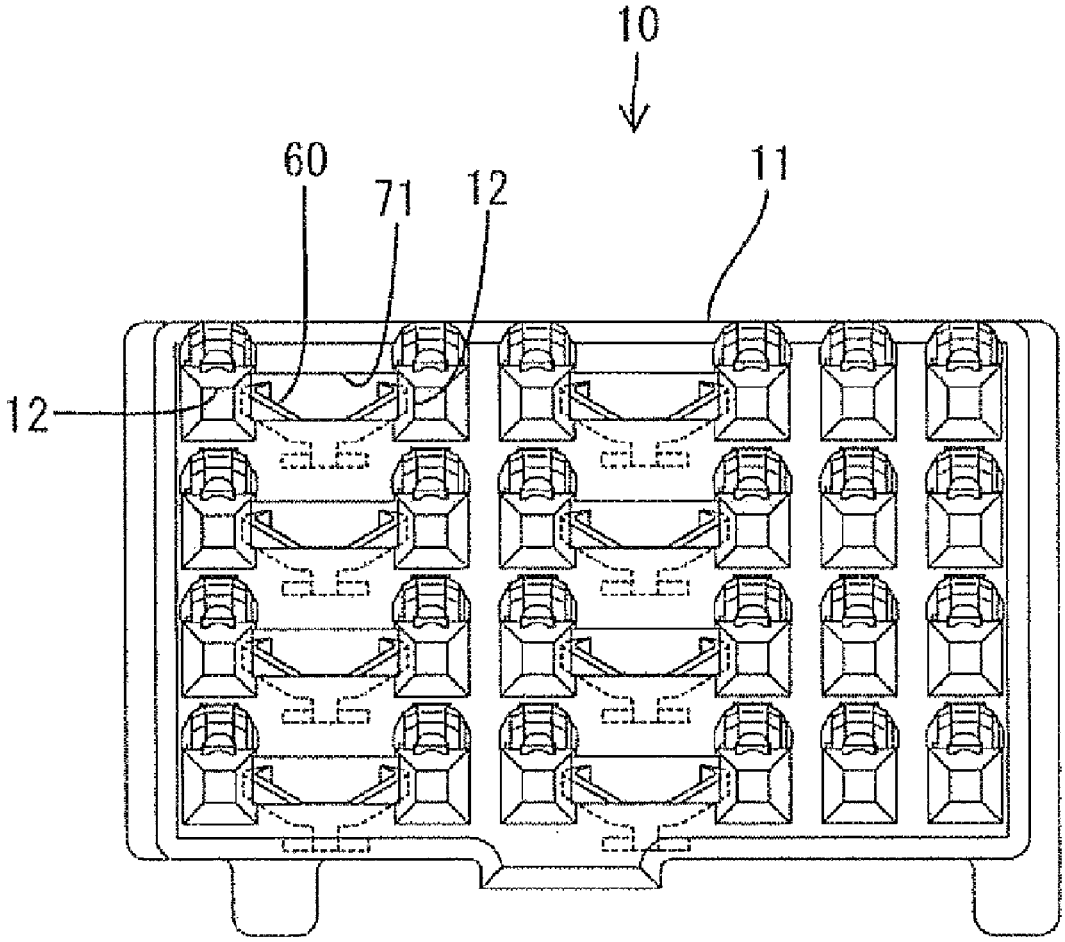
FIG. 12 is a front view showing a state where shorting terminals are inserted in an auxiliary connector in a third embodiment.

A single entrance hole 71 is formed between each pair of laterally adjacent cavities 12 at the front of the auxiliary connector 11, as shown in FIG. 12. The entrance hole 71 communicates with the upper accommodating portion 70A of the terminal accommodating portion 70. On the other hand, the male connector 30 is formed with a single releasing rib 36 that conforms with the outer shape of the entrance hole 71 so as to be insertable therein instead of the pair of releasing ribs 35 of the first embodiment. In other words, the releasing rib 36 of this embodiment can be thicker than the releasing rib 35 of the first embodiment and can have higher rigidity.

Figure 14:
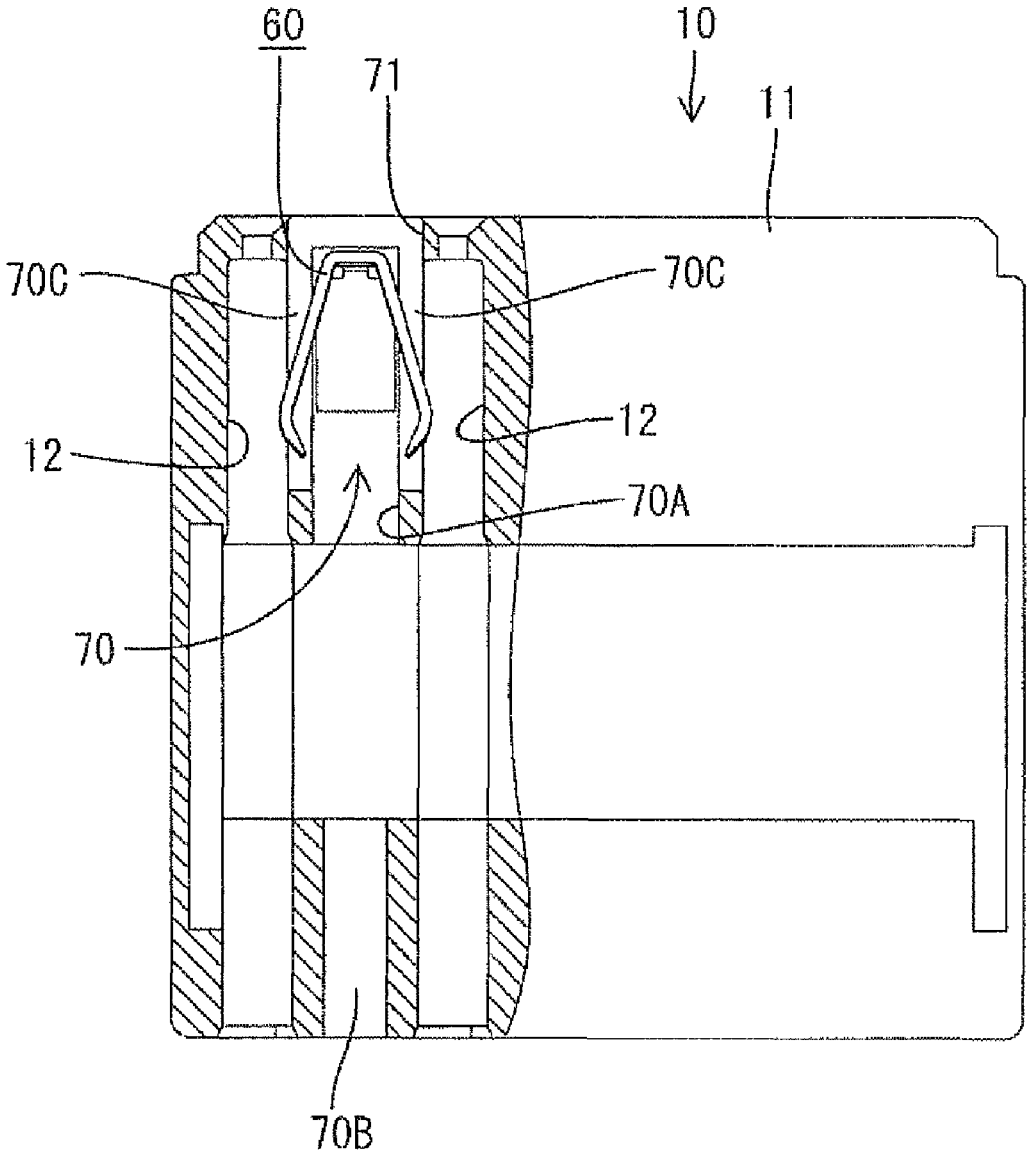
FIG. 14 is a plan view partly in section showing a state where the shorting terminal is mounted in the auxiliary connector.
Figure 15:
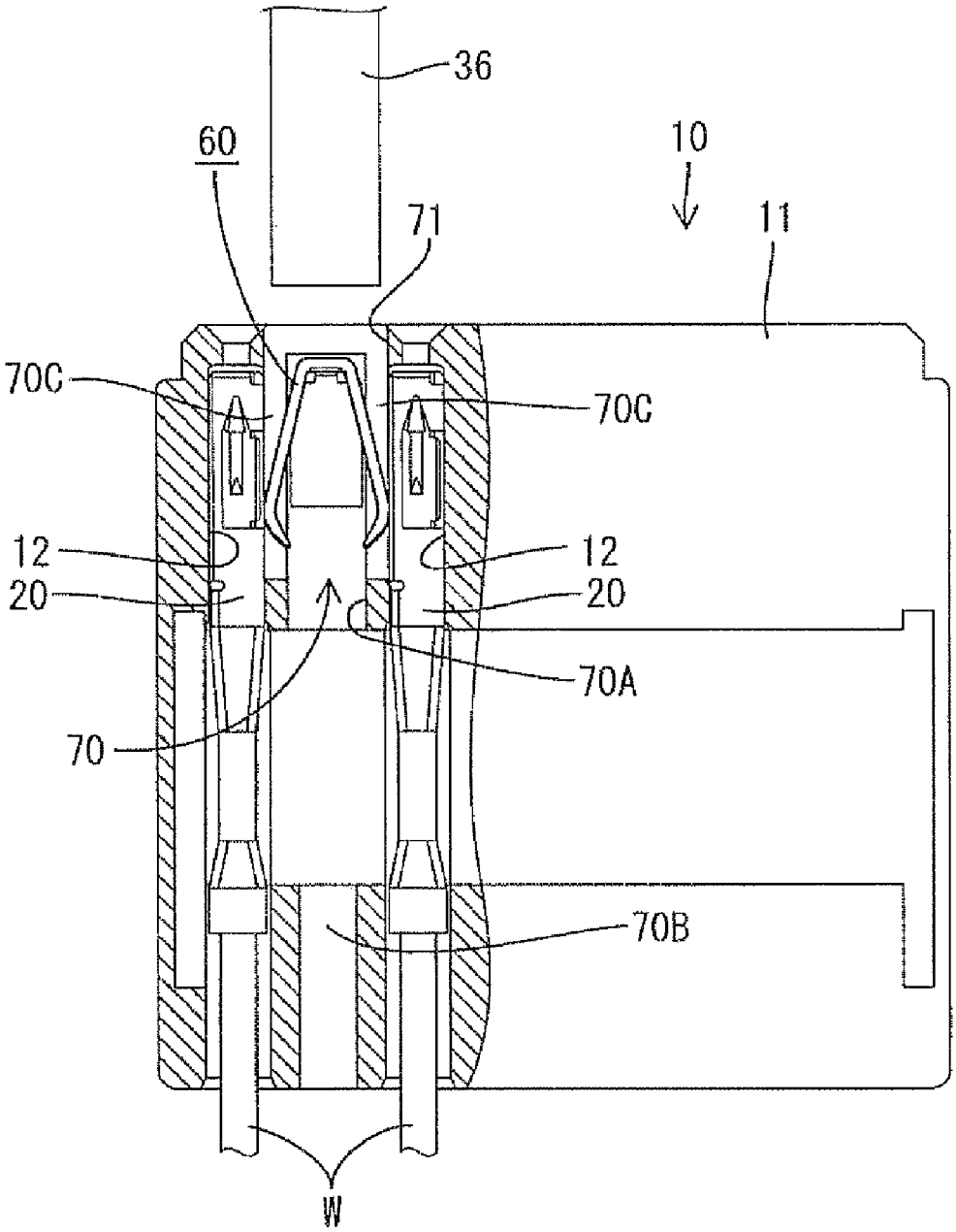
FIG. 15 is a plan view partly in section showing a state where female terminal fittings are mounted in the auxiliary connector.
Figure 17:
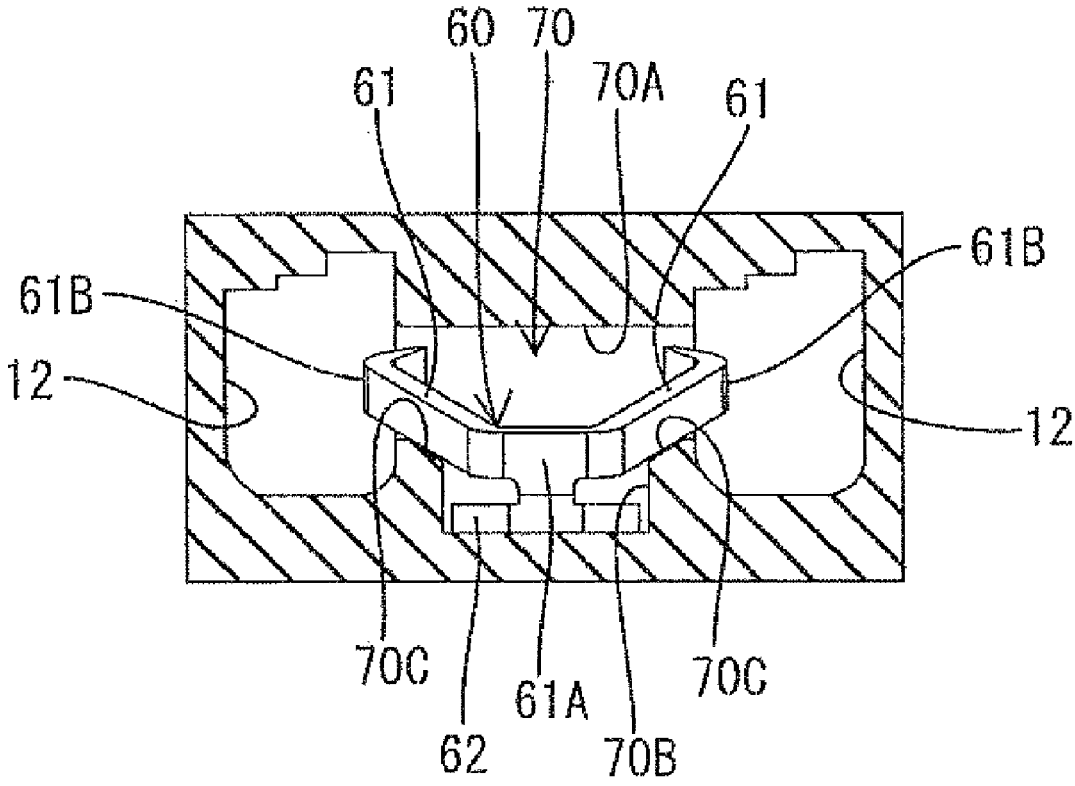
FIG. 17 is an enlarged section viewed from the front showing the shorting terminal accommodated in the terminal accommodating portion.
Figure 18:
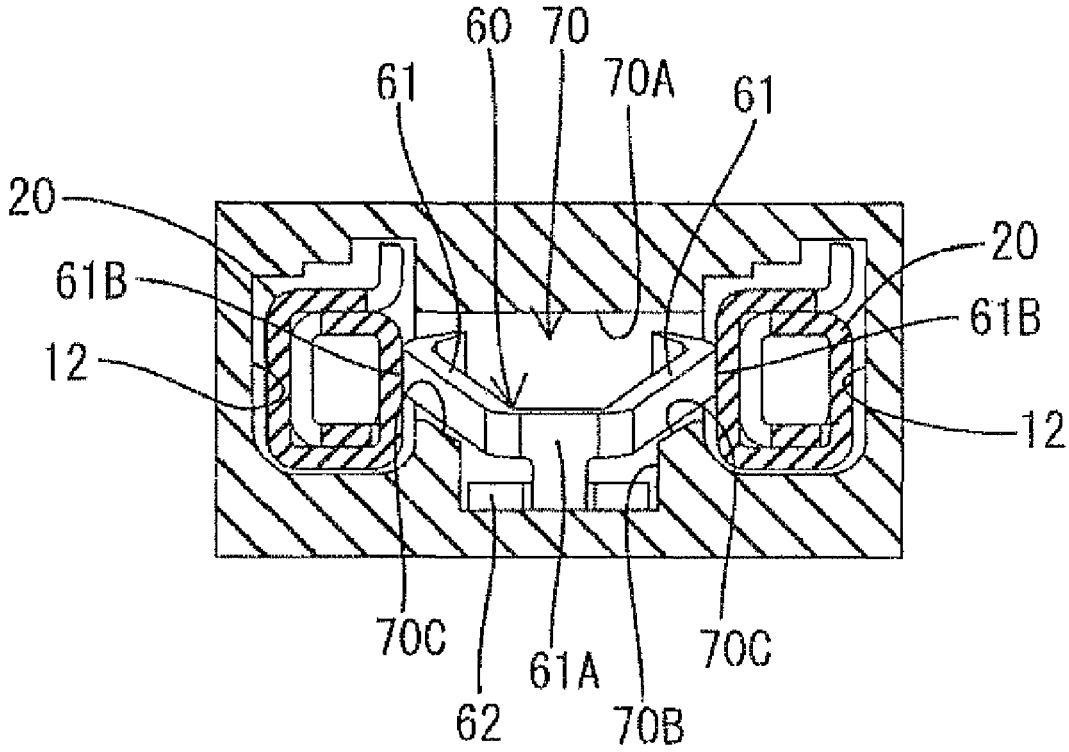
FIG. 18 is an enlarged section viewed from front showing a state where the female terminal fittings are accommodated in cavities.

Upper edges of the contact pieces 61 are exposed to the front through the entrance hole 71 when the shorting terminal 60 is accommodated in the terminal accommodating portion 70, as shown in FIG. 12. At this time, the contact pieces 61 project from the upper accommodating portion 70A into the opposite left and right cavities 12, as shown in FIG. 14 or 17 and contact points 61B of the contact pieces 61 are located on entrance paths for the left and right female terminal fittings 20. The female terminal fittings 20 slide on the contact points 61B and deform the contact pieces 61 resiliently inward when the female terminal fittings 20 are inserted into the respective cavities 12, as shown in FIG. 15 or 18. At this time, the lower edges of the contact pieces 61 extend substantially along the inclined surface of the guide 70C and the upper edges thereof are located on an entrance path for the releasing rib 36.

Figure 13:
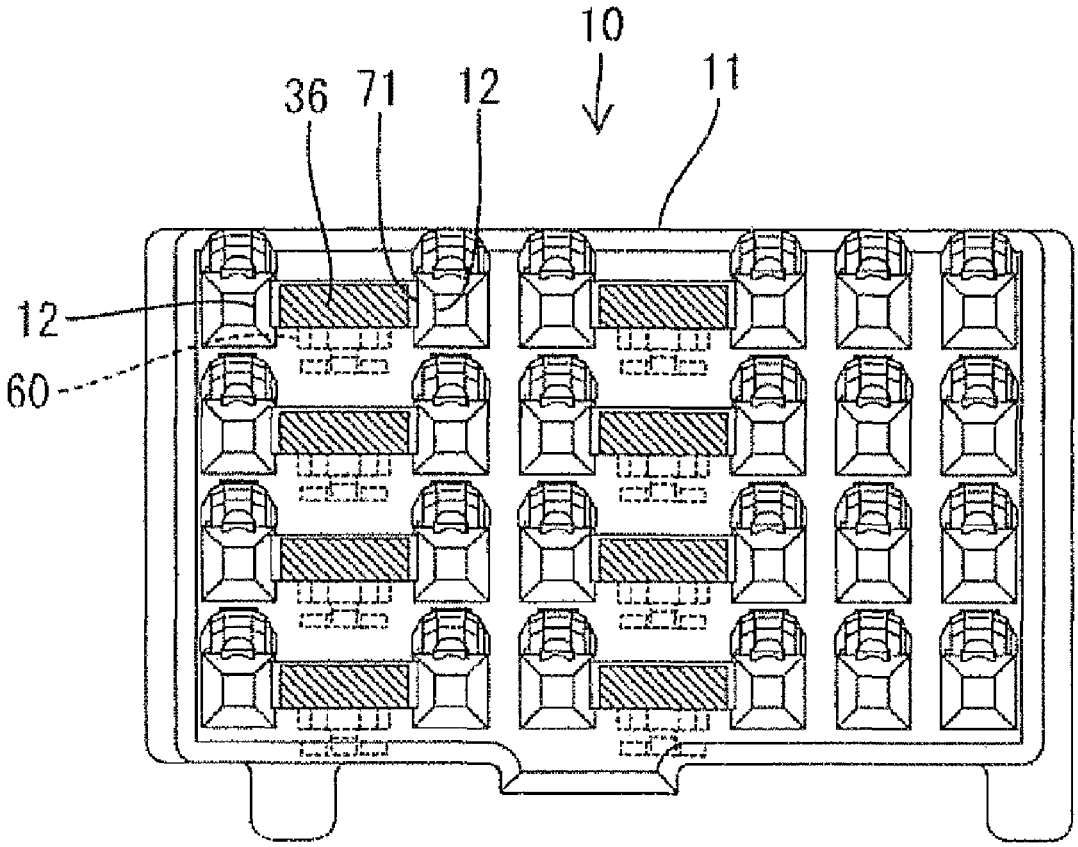
FIG. 13 is a front view showing a state where releasing ribs are inserted in the auxiliary connector.
Figure 16:
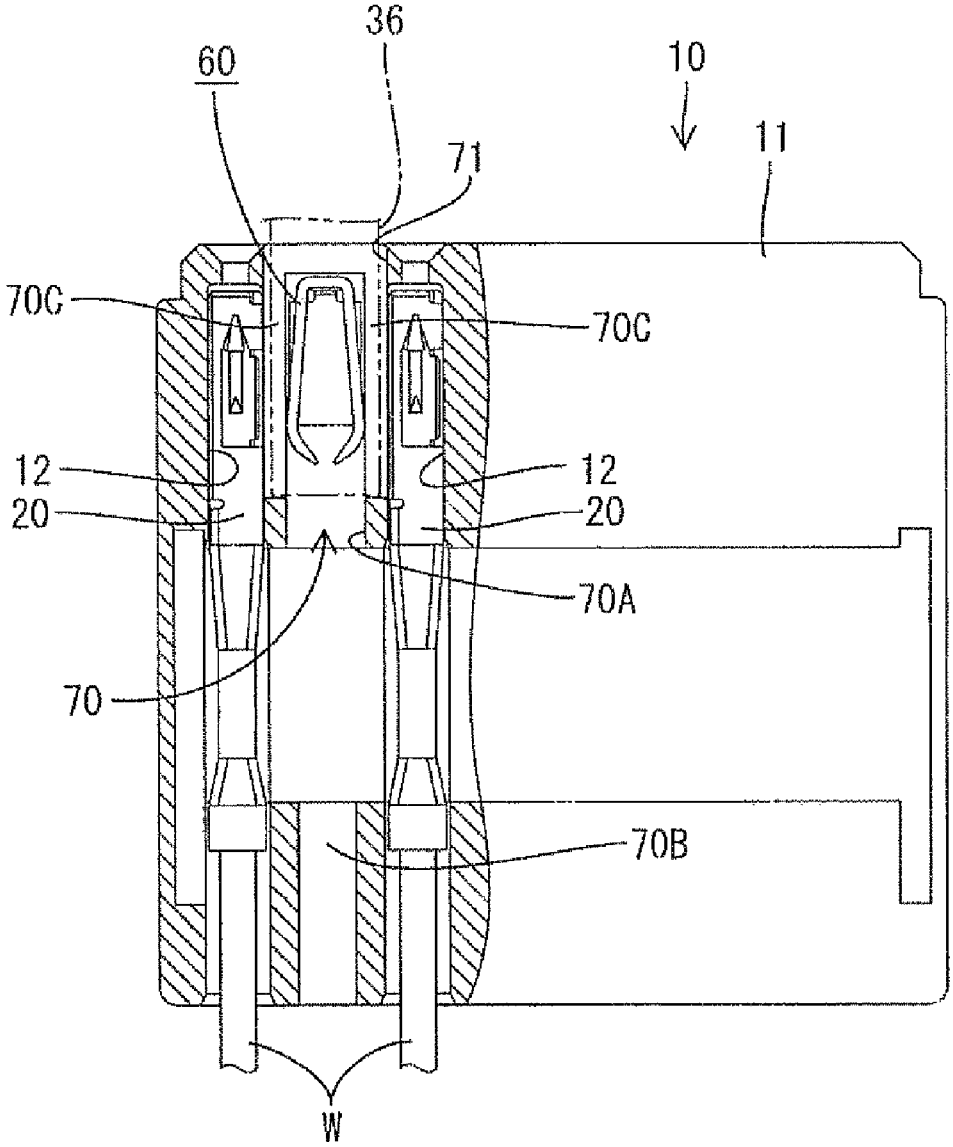
FIG. 16 is a plan view partly in section showing a state where the releasing rib is inserted in the auxiliary connector.
Figure 19:
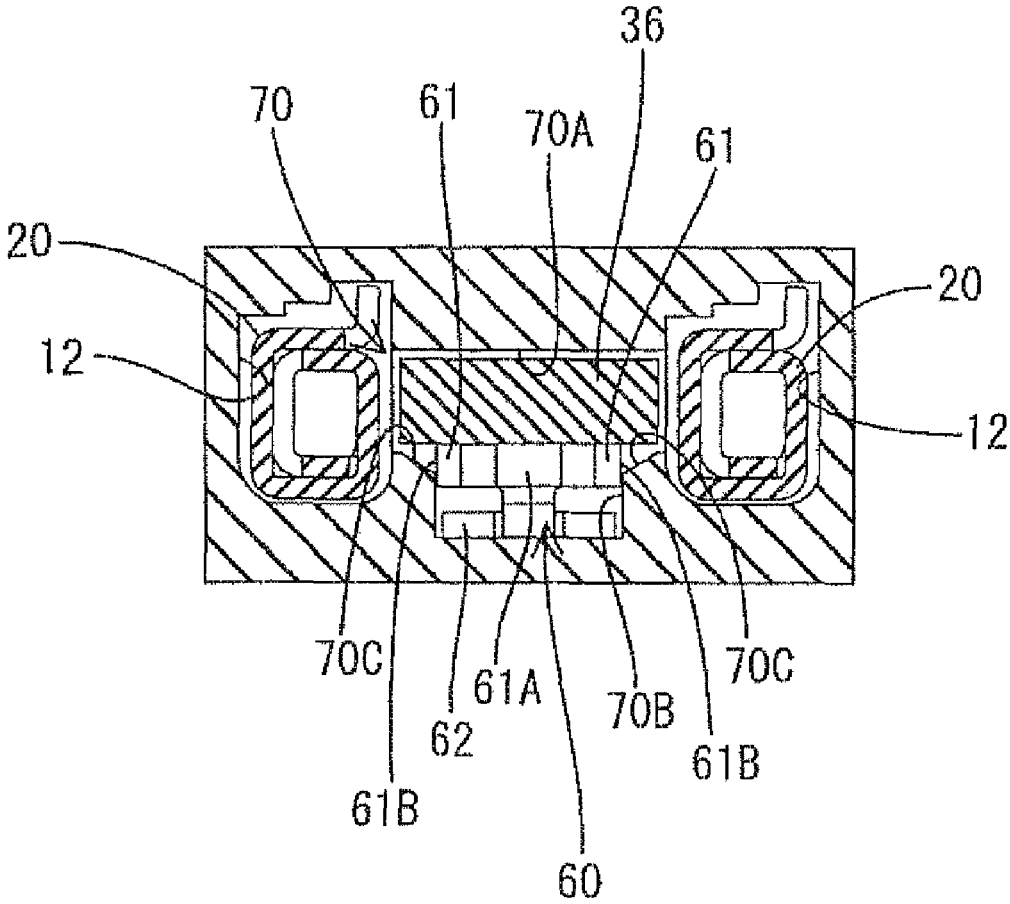
FIG. 19 is an enlarged section viewed from the front showing the releasing rib accommodated in the terminal accommodating portion.

Each releasing rib 36 is inserted through the entrance hole 71 and into the upper accommodating portion 70A as the two connectors 10, 30 are connected. Thus, the leading end of the releasing rib 36 slides in contact with the upper edges of the contact pieces 61 to displace the contact pieces 61 down and substantially normal to a plane containing the longitudinal axes of the adjacent female terminal fittings 20. Additionally, the lower edges of the contact pieces 61 slide in contact with the inclined surface of the guide 70C to displace the contact pieces 61 toward each other as shown in FIG. 16 or 19. As a result, the shorting terminal 60 is moved below the entrance hole 71 as shown in FIG. 13, and retracts from the entrance path for the releasing rib 36.

As described above, both contact pieces 61 of the third embodiment are retracted from the entrance path of the releasing rib 36 as the releasing rib 36 is inserted. Thus, the single releasing rib 36 can be thicker and more rigid than the releasing rib 35 of the first embodiment. The more rigid releasing rib 36 enables the distance between the pair of laterally adjacent female terminal fittings 20 to be shortened even more.

A shorting terminal of a fourth embodiment of the invention is identified by the numeral 80 in FIGS. 25 to 29. The shorting terminal 80 is obtained by partly changing the construction of the shorting terminal 40 of the first embodiment. Elements of the shorting terminal 80 that are the same as or similar to the first embodiment are identified by the same reference numerals, but are not described again.

The fourth embodiment differs from the first embodiment in that the releasing rib 35 is thrust between only a first of the contact pieces and the female terminal fitting 20. The second contact piece and the female terminal fitting 20 remain in contact, but the two female terminal fittings 20 are electrically released by releasing only the contact point of the one contact piece and the female terminal fitting 20.

Only the first contact piece is deformed resiliently and the second contact piece need not deform. Thus, it is not necessary to provide a space for the second contact piece to be deformed by the releasing rib 35 and a wider space can be ensured for the resilient deformation of the first contact piece by the releasing rib 35. This wide space ensures a larger part for distributing stress when the first contact piece receives the stress from the releasing rib 35. As a result, the first contact piece is formed so that stress is unlikely to concentrate. More particularly, embodiments with releasing ribs 35 that resiliently deform both contact pieces require space for the deformations of both contact pieces. Therefore, parts of the contact pieces for distributing stress become smaller. Stress is concentrated on the smaller contact pieces and the respective contact pieces are more likely to be subjected to plastic deformation. As a countermeasure, it is thought to form the contact pieces from a material with good springiness. However, a material with good springiness is more costly and reduces the selection of materials. Stress is not likely to concentrate if only one contact piece is deformed resiliently and it is unnecessary to use a material with good springiness. Therefore, there is a wider range of material selection and a free design is enabled.

Figure 28:
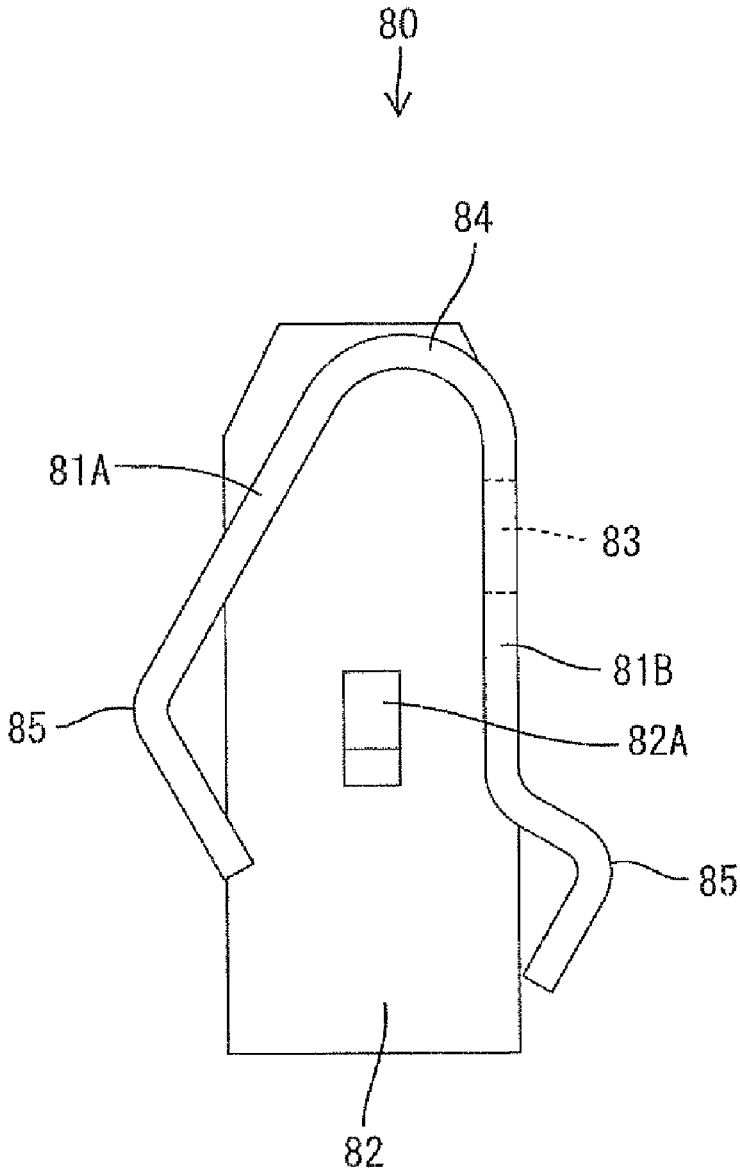
FIG. 28 is a plan view of the shorting terminal.
Figure 29:
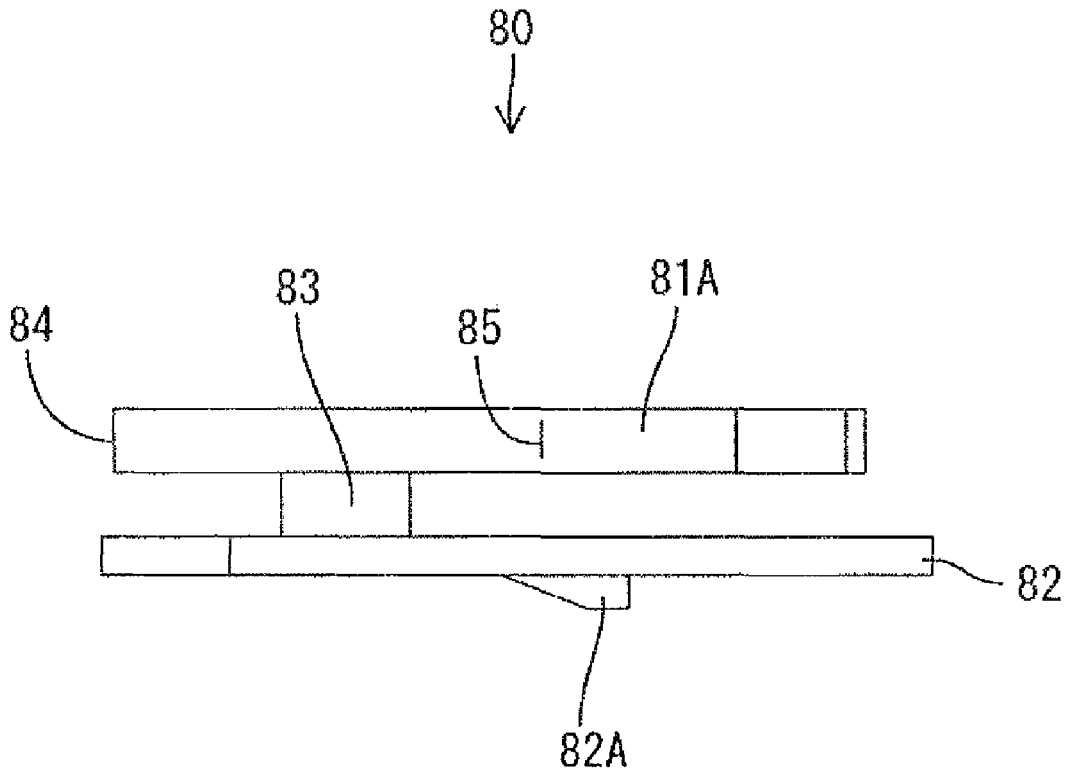
FIG. 29 is a side view of the shorting terminal.

The shorting terminal 80 of this embodiment includes a supporting base 82, a first contact piece 81A and a second contact piece 81B, as shown in FIGS. 28 and 29. The contact pieces 81A, 81B are substantially U- or V-shaped and extend backward from a fold 84 while facing each other.

Figure 26:
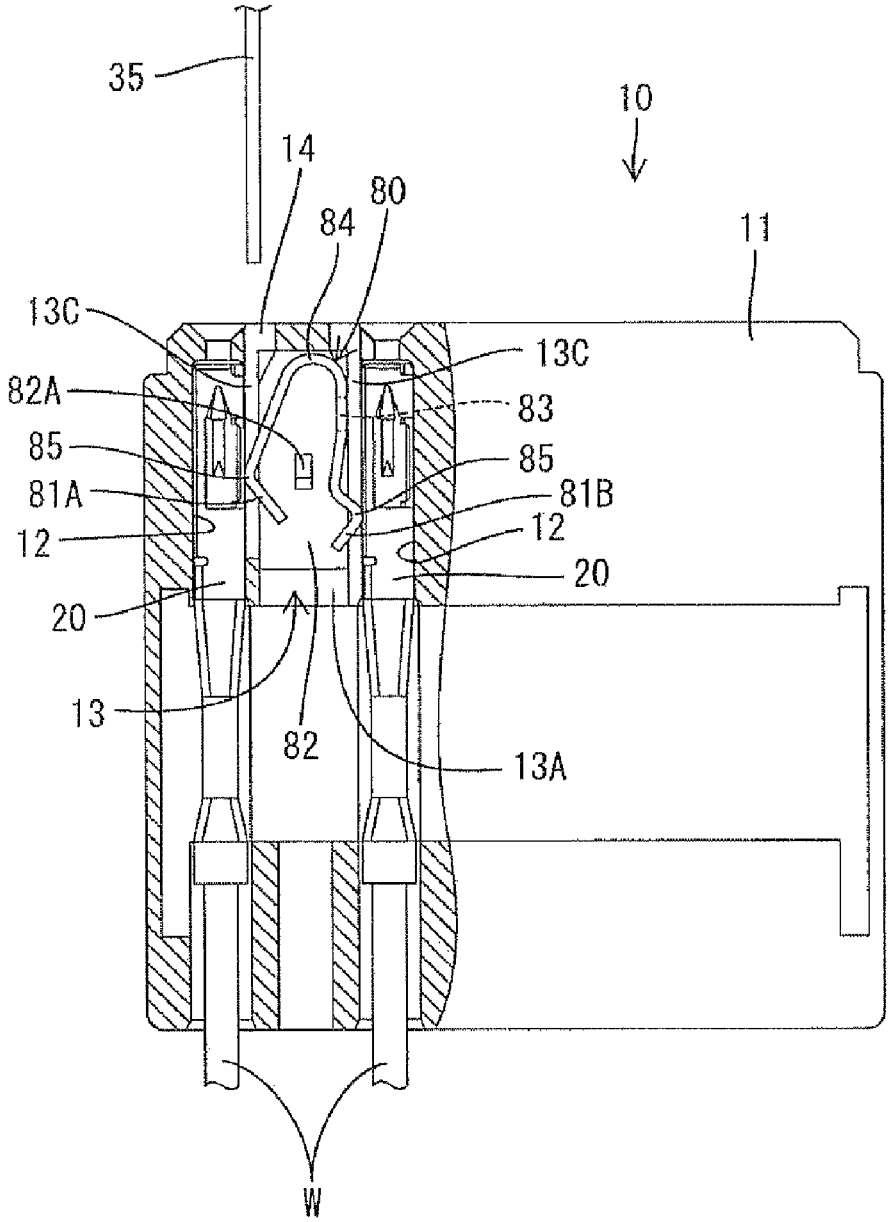
FIG. 26 is a plan view partly in section showing a state where female terminal fittings are mounted in the auxiliary connector.

The base ends of the contact pieces 81A, 81B are connected with each other via a joint 83. The joint 83 is closer to right female terminal fitting 20 that contacts the second contact piece 81B than to the left female terminal fitting 20 that contacts the first contact piece 81A, as shown in FIG. 26, with both female terminal fittings 20 inserted in the cavities 12.

Specifically, the joint 83 projects from the right side edge of the supporting base 82. A substantially U-shaped cut is made substantially in the center of the supporting base 82 and is deformed, bent, embossed or hammered down to form a retaining piece 82A projecting slightly downward. The retaining piece 82A is engageable with a retaining projection (not shown) formed on the bottom surface of the lower accommodating portion 13A of the terminal accommodating portion 13. In this way, the shorting terminal 80 is retained in the terminal accommodating portion 13 by engaging the retaining piece 82A with the retaining projection.

The first contact piece 81A extends forward from the front edge of the upper end of the joint 83 and then extends obliquely back to the left via the fold 84. A leading end of the first contact piece 81A is bent toward the second contact piece 81B to form a mountain-shaped or pointed contact point 85. On the other hand, the second contact piece 81B extends back from the rear edge of the upper end of the joint 83 and a mountain-shaped or pointed contact portion 85 is provided near the leading end of the second contact piece 81B by projecting out toward a side opposite to the first contact piece 81A and then is folded or bent in toward the first contact piece 81A. A distance from the joint 83 to the leading end of the first contact piece 81A is longer than a distance from the joint 83 to the leading end of the second contact piece 81B.

The folded portion 84 is deformed resiliently when the first contact piece 81A is deformed resiliently in and receives stress resulting from this resilient deformation. The folded portion 84 has a moderate arcuate shape over more than about half (preferably over about ⅔) of the entire width of the terminal accommodating portion 13. Thus, the stress resulting from the resilient deformation can be distributed in this moderately arcuate part. Accordingly, the stress is distributed in the entire folded portion 84 when the releasing rib 35 resiliently deforms the first contact piece 81A. Therefore, the plastic deformation of the folded portion 84 is prevented.

Figure 25:
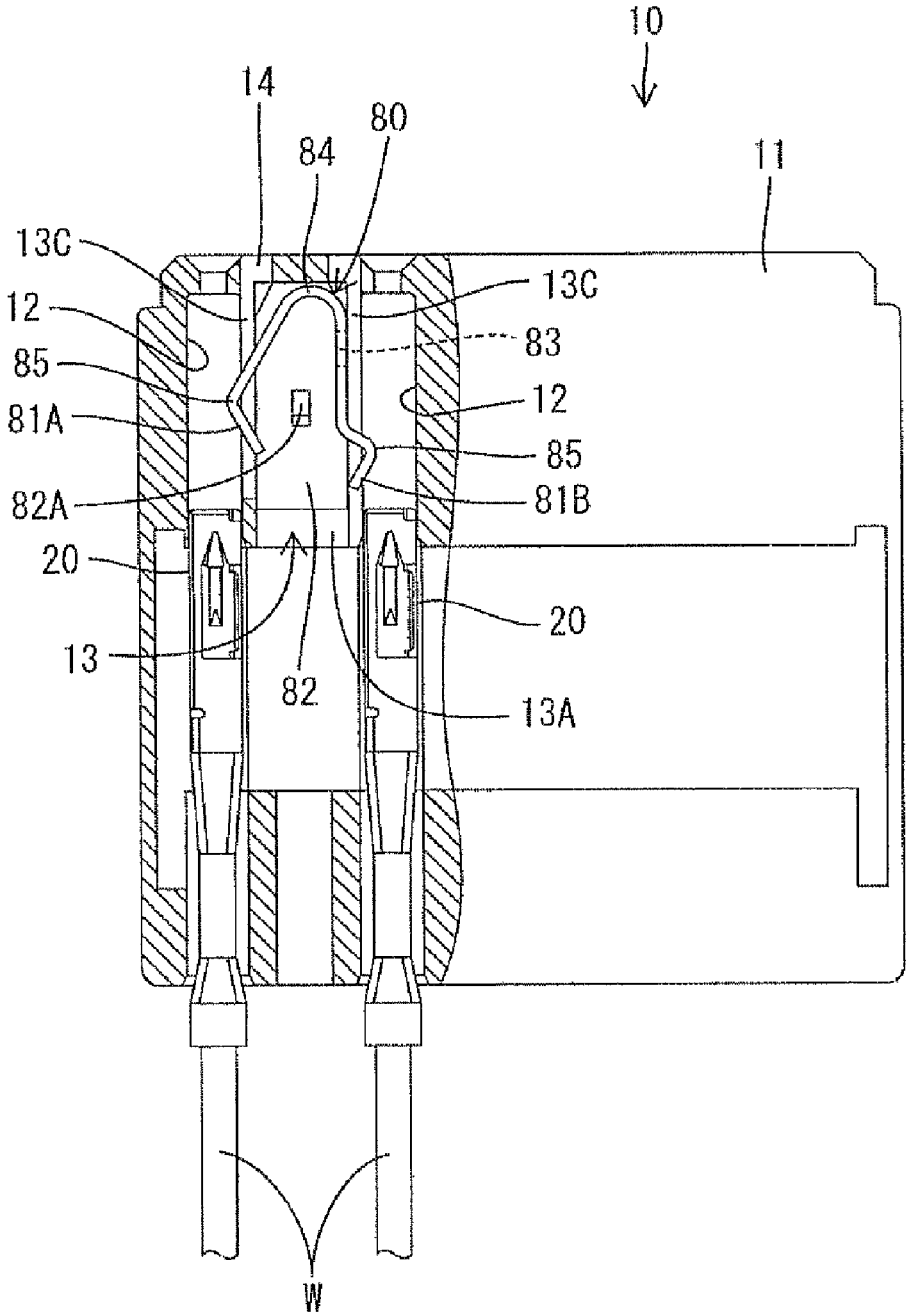
FIG. 25 is a plan view partly in section showing a state where a shorting terminal is mounted in an auxiliary connector in a fourth embodiment.

The contact points 85 are in the corresponding cavities 12 when the shorting terminal 80 is in the terminal accommodating portion 13, as shown in FIG. 25, and the leading ends of the respective female terminal fittings 20 can contact the inclined surfaces extending from the respective contact points 85 to the leading ends. More particularly, the female terminal fittings 20 are inserted into the cavities 12 from behind, so that the leading ends of the female terminal fittings 20 slide in contact with the inclined surfaces at the leading ends of the respective contact pieces 81A, 81B. As a result, the respective contact pieces 81A, 81B are deformed resiliently inward and the respective contact points 85 contact side surfaces of the corresponding female terminal fittings 20, as shown in FIG. 26. In this way, both female terminal fittings 20 are shorted. It should be noted that the second contact piece 81B is deformed resiliently inward with a part thereof connected with the joint 83 as a base.

The connector is assembled by inserting the female terminal fittings 20 into the respective cavities 12. The contact points 85 pass through the respective insertion holes 13C and into the cavities 12, as shown in FIG. 25. Thus, the contact pieces 81A, 81B are displaced toward each other as the female terminal fittings 20 are inserted. The contact pieces 81A, 81B are held in contact with the respective female terminal fittings 20 at the left and right sides, as shown in FIG. 26, when the female terminal fittings 20 reach proper insertion positions. Thus, the pair of laterally adjacent female terminal fittings 20 are shorted electrically via the shorting terminal 80.

The auxiliary connectors 11 then are assembled into the holder and the lever is set at a position so that the cam groove thereof can receive the cam pin 34. The two connectors 10, 30 then are fit lightly together so that the cam pin 34 enters of the cam groove. The lever is rotated in this state so that the engagement of the cam pin 34 and the cam groove generates a cam action that urges the connectors 10, 30 toward each other so that the holder is inserted into the receptacle 32. The female and male terminal fittings 20, 33 are connected electrically when the connectors 10, 30 are properly connected in this way.

Figure 27:
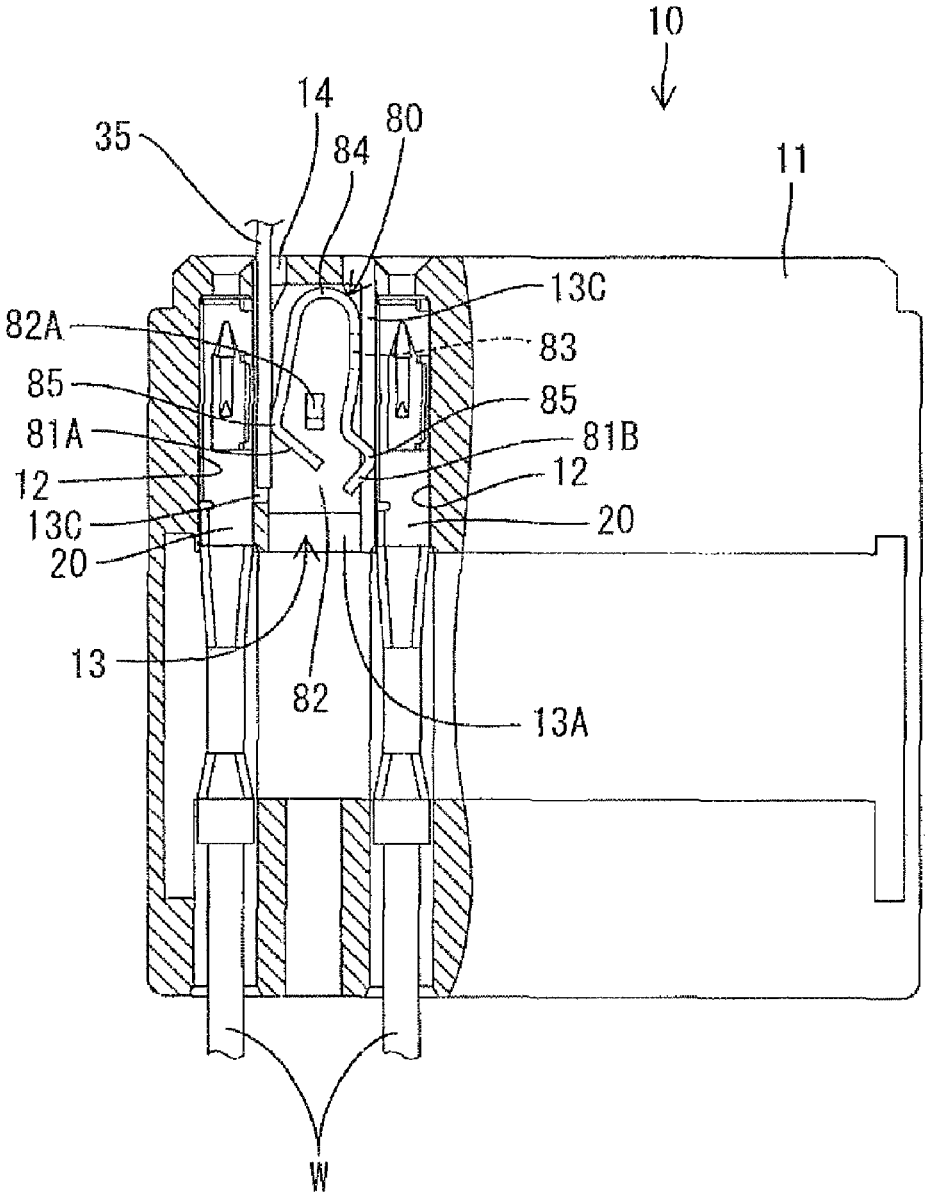
FIG. 27 is a plan view partly in section showing a state where a releasing rib is inserted in the auxiliary connector.

Substantially simultaneously with this operation, the releasing rib 35 passes through the entrance hole 14, enters the insertion hole 13C and is thrust between the contact piece 81A and the female terminal fitting 20 that is held in contact at one side, as shown in FIG. 27. Thus, the left female terminal fitting 20 is separated from the shorting terminal 80 so that the two female terminal fittings 20 are released electrically. At this time, the first contact piece 81A is deformed resiliently inward through the resilient deformation of the folded portion 84. Accordingly, the stress the one contact piece 81A receives from the releasing rib 35 can be distributed over a larger part the folded portion 84 to avoid plastic deformation of the first contact piece 81A. On the other hand, the second contact piece 81B is kept in contact with the right female terminal fitting 20 and receives no stress from the releasing rib 35.

As described above, a wide space is ensured by arranging the joint 83 close to the right female terminal fitting 20. The moderately arcuate fold 84 is provided in this wide space and the first contact piece 81A is deformed resiliently by the fold 84. Thus, the stress received from the releasing rib 35 is distributed in the entire fold 84. Therefore, plastic deformation of the fold 84 is prevented and the range of material selection for the contact pieces 81A, 81B is widened.

Figure 30:
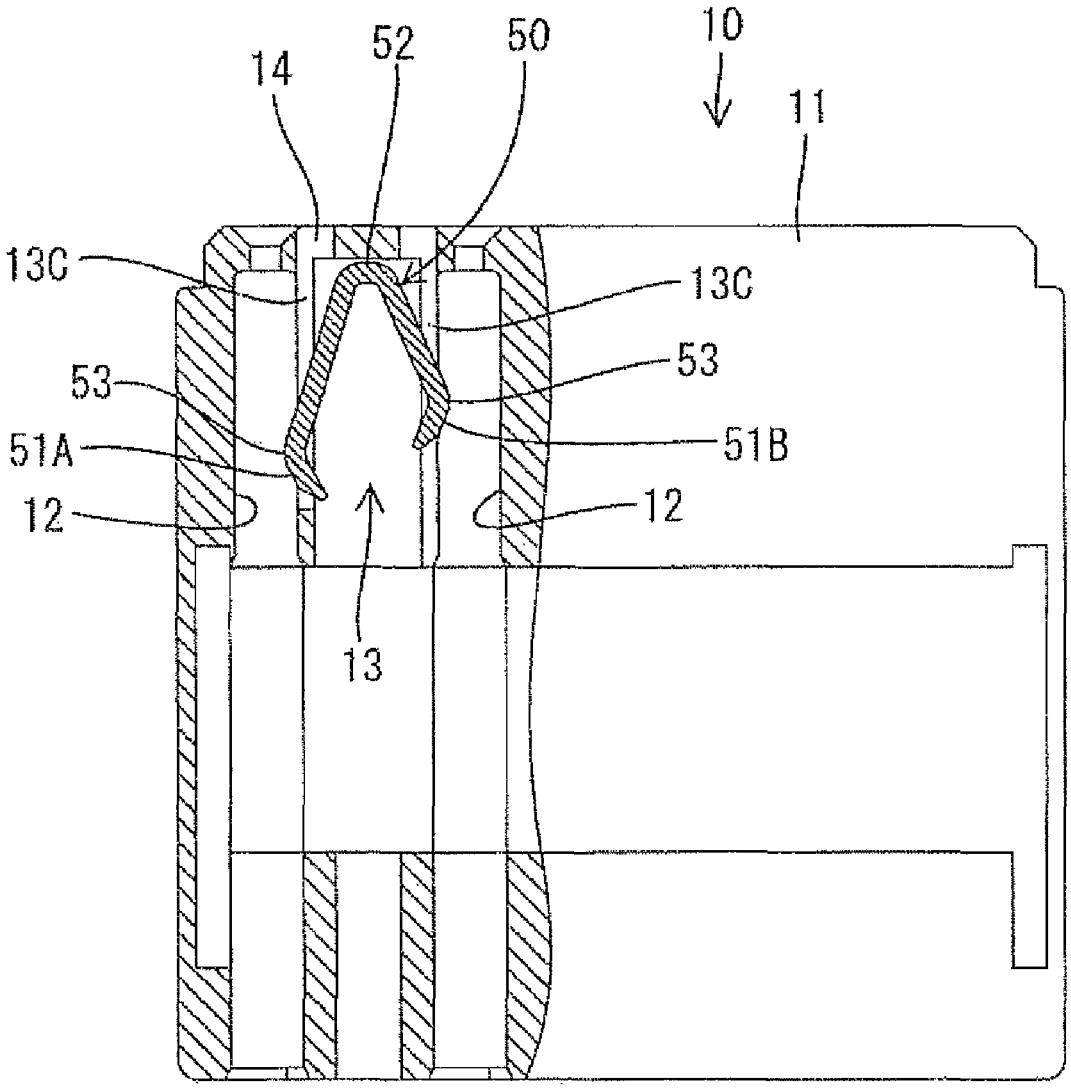
FIG. 30 is a plan view partly in section showing a state where a shorting terminal is mounted in an auxiliary connector in a fifth embodiment.
Figure 31:
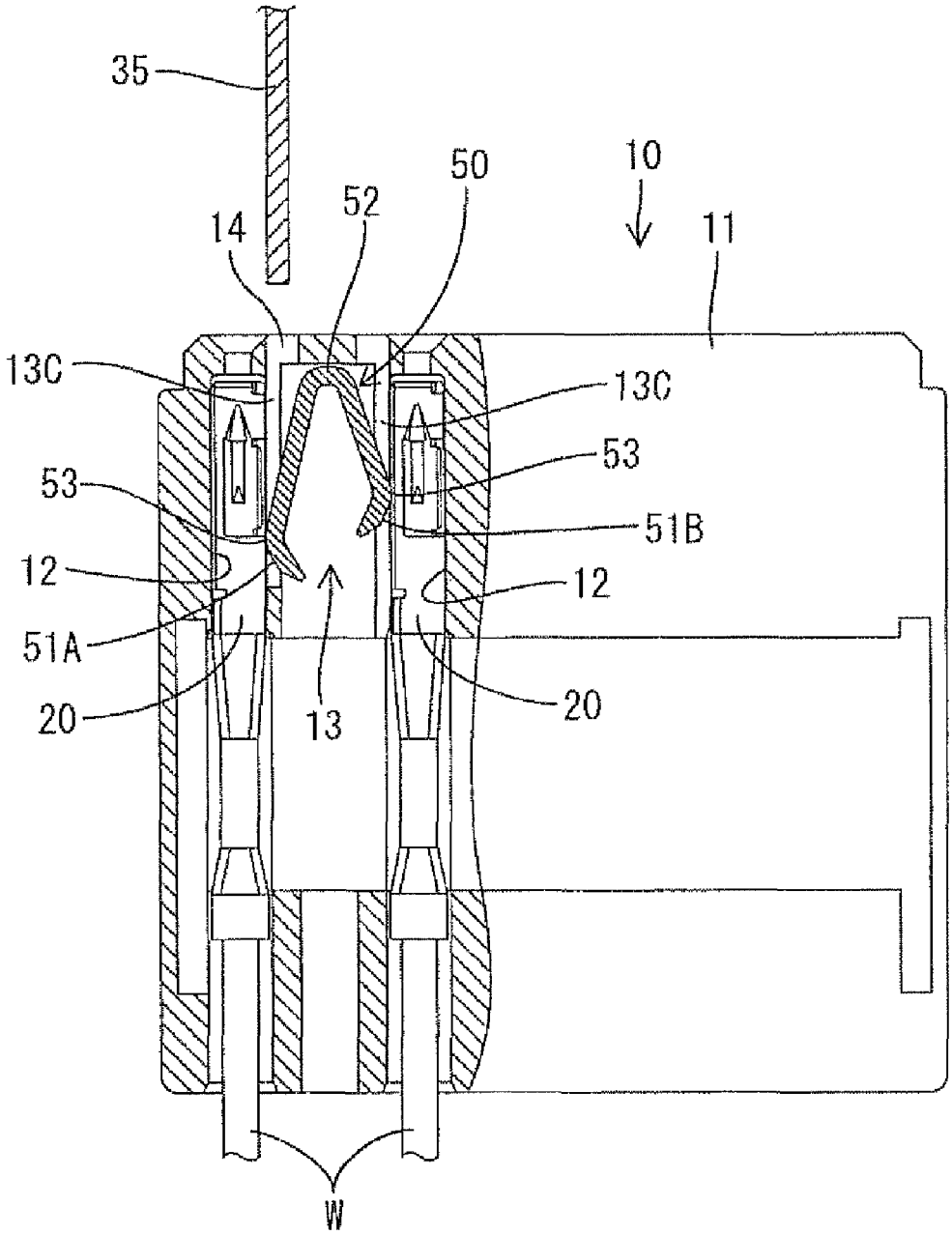
FIG. 31 is a plan view partly in section showing a state where female terminal fittings are mounted in the auxiliary connector.
Figure 32:
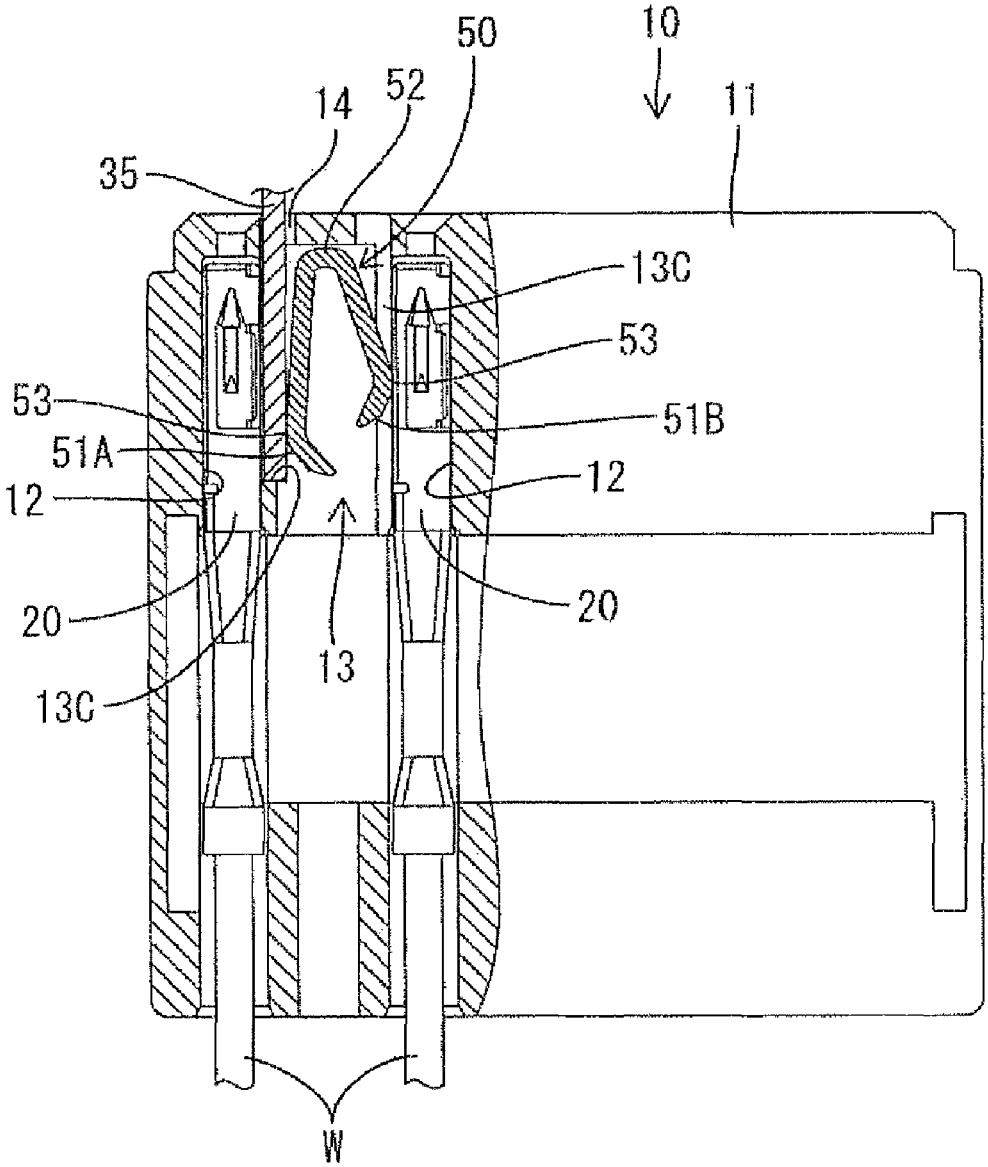
FIG. 32 is a plan view partly in section showing a state where a releasing rib is inserted in the auxiliary connector.

A shorting terminal of a fifth embodiment of the invention is identified by the numeral 50 in FIGS. 30 to 32. This embodiment is a modification of the fourth embodiment. The structure of the shorting terminal is substantially the same as the shorting terminal of the second embodiment. Thus, the following description focuses on the functions of the shorting terminal 50.

The shorting terminal 50 has a first contact piece 51A that is longer than the second contact piece 51B, as shown in FIG. 30. Specifically, a distance from a joint 52 that connects the base ends of the contact pieces 51A, 51B to the leading end of the first contact piece 51A is longer than that from the joint 52 to the leading end of the second contact piece 51B. The joint 52 is in the lateral center in the terminal accommodating portion 13.

Inserting the female terminal fittings 20 into the respective cavities 12 causes contact points 53 at leading ends of the contact pieces 51A, 51B to be brought respectively into contact with side surfaces of the left and right female terminal fittings 20, as shown in FIG. 31.

If the two connectors 10, 30 are connected, the releasing rib 35 is thrust between the first contact piece 51A and the left female terminal fitting 20 and only the first contact piece 51A is displaced inwardly, as shown in FIG. 32. Thus, the female terminal fittings 20 are released and disconnected electrically. On the other hand, the right contact piece 51B is kept in contact with the right female terminal fitting 20. Accordingly, a displacement amount of the joint 52 is small as compared with the case where both contact pieces 51A, 51B are deformed resiliently. Further, the longer left contact piece 51A is deformed resiliently, the displacement amount of the joint 52 can be more suppressed more than in the case of resiliently deforming the shorter right contact piece 51B. Therefore, plastic deformation of the joint portion 52 is prevented.

Figure 33:
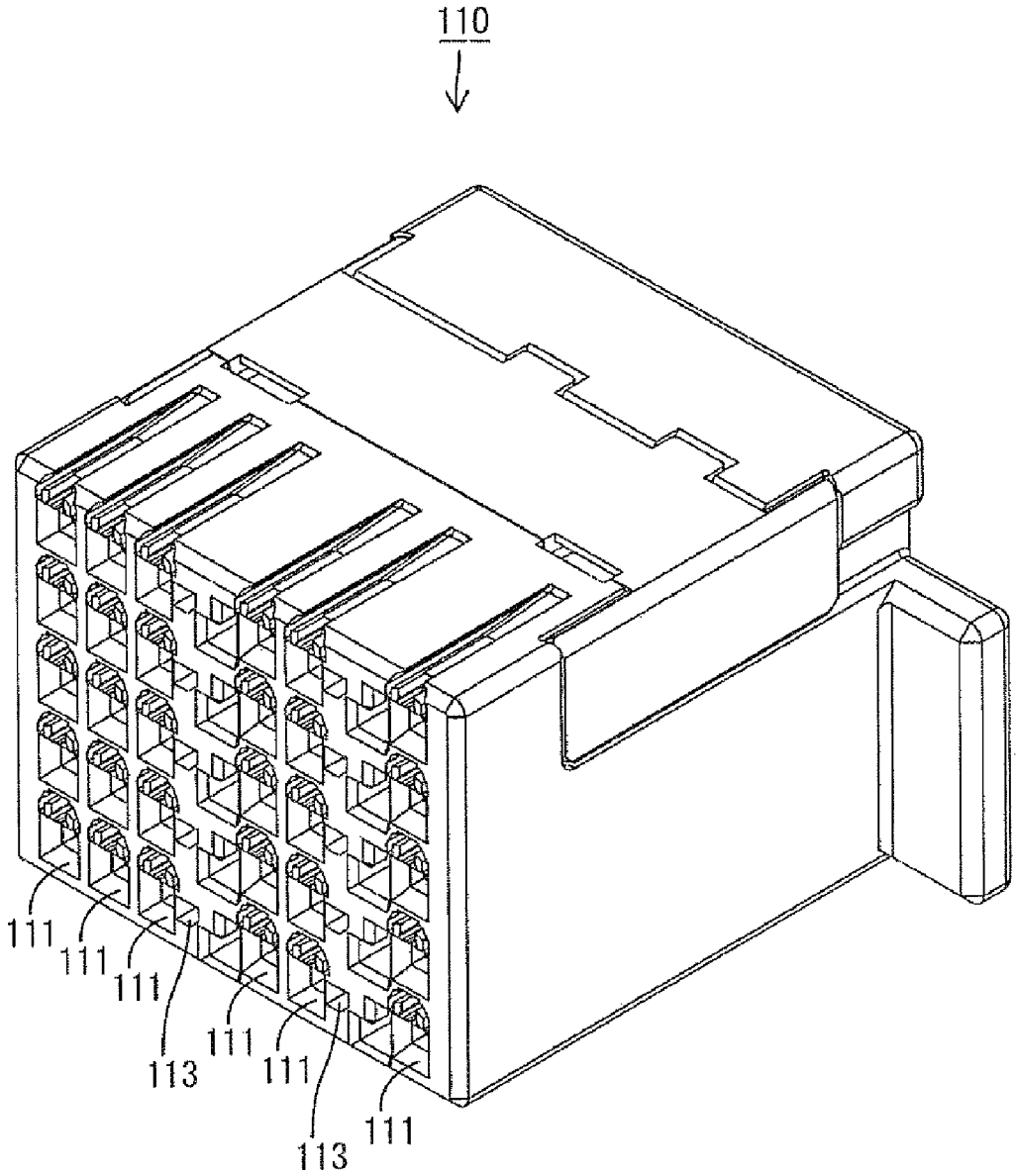
FIG. 33 is a perspective view of a housing when viewed obliquely from front in a sixth embodiment.

A connector in accordance with a sixth embodiment of the invention is illustrated in FIGS. 33 to 52. The connector includes a substantially block-shaped housing 110 made e.g. of synthetic resin, as shown in FIG. 33. Cavities 111 are arranged in vertical and lateral directions to penetrate the housing 110 in forward and backward directions. In the following description, based on a connecting direction of the connector, a connection surface side is referred to as the front side concerning forward and backward directions. Further, the vertical direction is orthogonal to forward and backward directions and is the vertical direction in FIG. 33. The lateral direction is orthogonal to both forward and backward directions and the vertical direction.

The connector of this embodiment is connectable with a mating connector that includes a mating housing (not shown) made e.g. of synthetic resin. The mating housing includes a hood-shaped receptacle (not shown) with an open front for receiving the housing 110. Tab-shaped terminals (not shown) and releasing ribs R project from the back wall of the receptacle.

Terminal fittings 120 are insertable into the cavities 111 of the housing 110 from behind at positions conforming to the tab-shaped terminals of the mating connector. Thus, when the two connectors are connected, the terminal fittings 120 and the tab-shaped terminals connect electrically.

Figure 36:
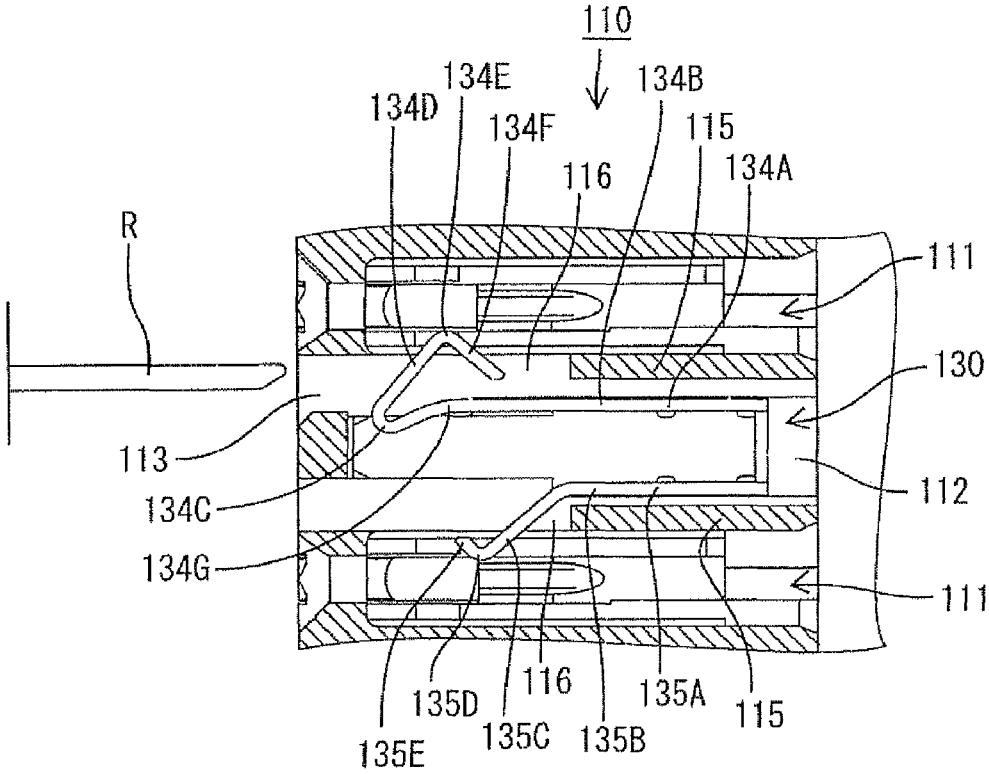
FIG. 36 is a side view in section showing a state viewed sideways before the releasing rib is inserted into the entrance hole in the case where the terminal fittings are not accommodated in the cavities.

The laterally adjacent cavities 111 in the first and second columns from the right in FIG. 33 form a set and the laterally adjacent cavities 111 in the third and fourth columns from the right form a set. Terminal accommodating portions 112 are arranged between the cavities 111 in each set, as shown in FIG. 36, and shorting terminals 130 are insertable into the respective terminal accommodating portions 112 from behind.

Entrance holes 113 are formed in the front surface of the housing 110 to provide communication between the insides and outsides of the respective terminal accommodating portions 112. The entrance holes 113 align with the releasing ribs R of the mating connector so that the releasing ribs 135 are insertable through the entrance holes 113 and into the terminal accommodating portions 112 as the connectors are connected. The interiors of the entrance holes 113 also communicate with the interiors of the cavities 111.

Figure 39:
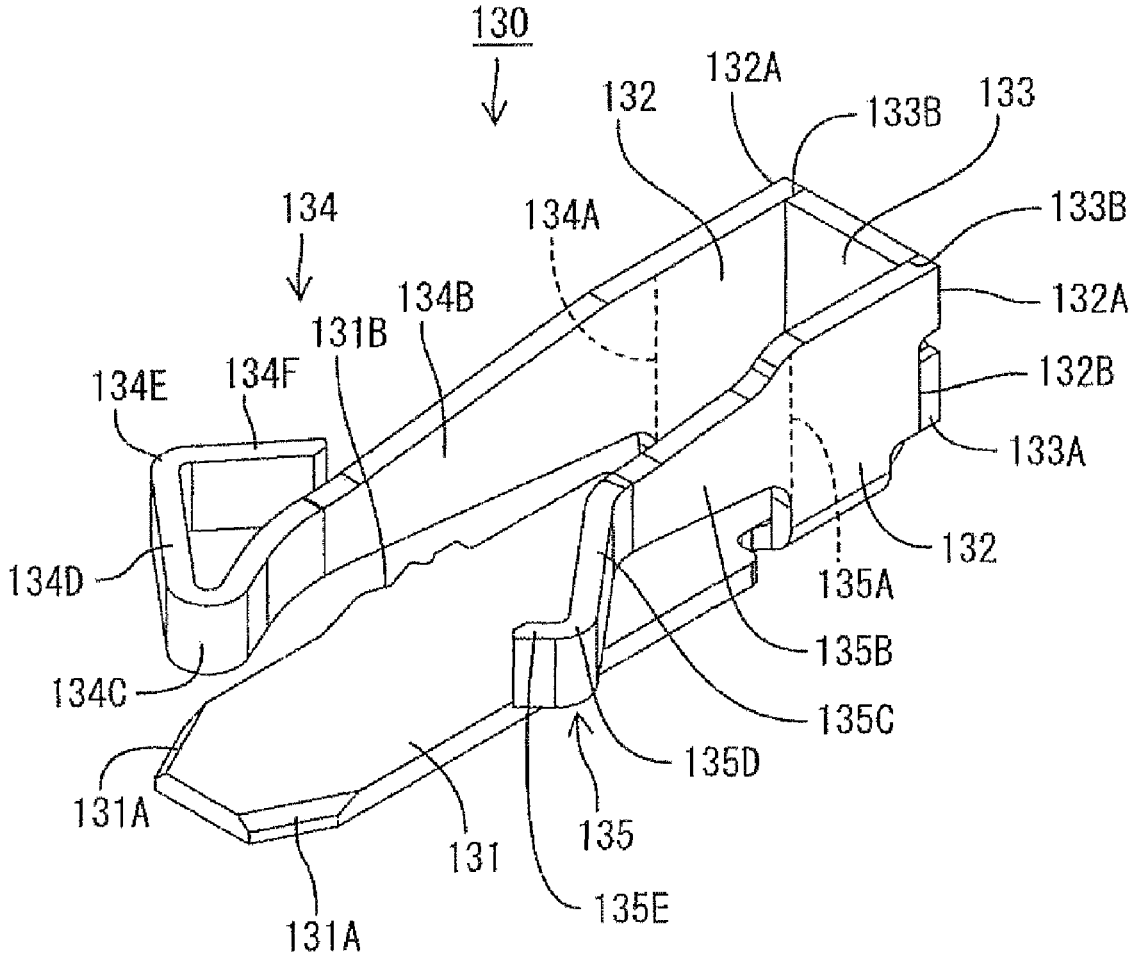
FIG. 39 is a perspective view showing a shorting terminal when viewed obliquely from front.
Figure 41:
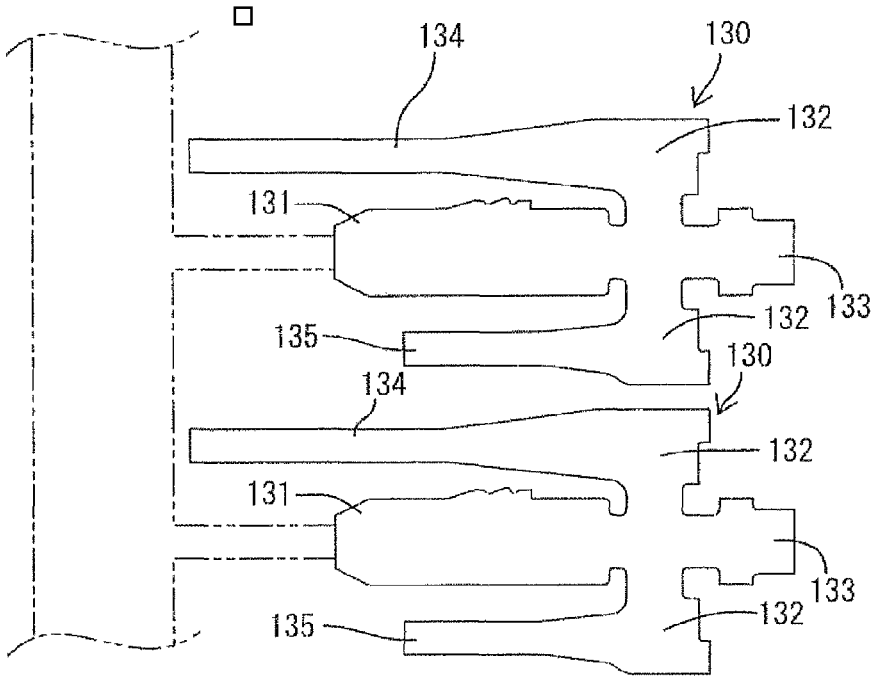
FIG. 41 is a plan view showing the shorting terminal in an unfolded state.

The shorting terminal 130 is formed by bending, folding and/or embossing a punched or cut out conductive metal plate, as shown in FIG. 41. The shorting terminal 130 has a bottom wall 131, opposed left and right side walls 132 projecting from opposite left and right sides of the bottom wall 131, a rear wall 133 standing up from the rear of the bottom wall 131, a long first contact piece 134 and a short second contact piece 135 extending forward from the fronts of the side walls 132, as shown in FIG. 39.

The opposite corners of the front edge of the bottom wall 131 are cut off and the upper edges of these cut-off portions are cut off further to form slanted surfaces 131A so that the thickness of the bottom wall 131 is smaller toward the outer ends. Further, a biting portion 131B projects out at the lateral edge of the bottom wall 131 corresponding to the first contact piece 134 for biting into the resin of the housing 110.

The opposite side walls 132 are connected with the rear ends of the opposite lateral edges of the bottom wall 131. Lower parts of the rear edges of the opposite side walls 132 are cut off by the thickness of the rear wall 133 to form cutouts 132B. The lower parts 133A of the opposite lateral edges of the rear wall 133 are engaged with the cutouts 132B of the opposite side walls 132 in forward and backward directions. Thus, the rear wall 133 cannot incline forwardly (see FIG. 43).

Figure 40:
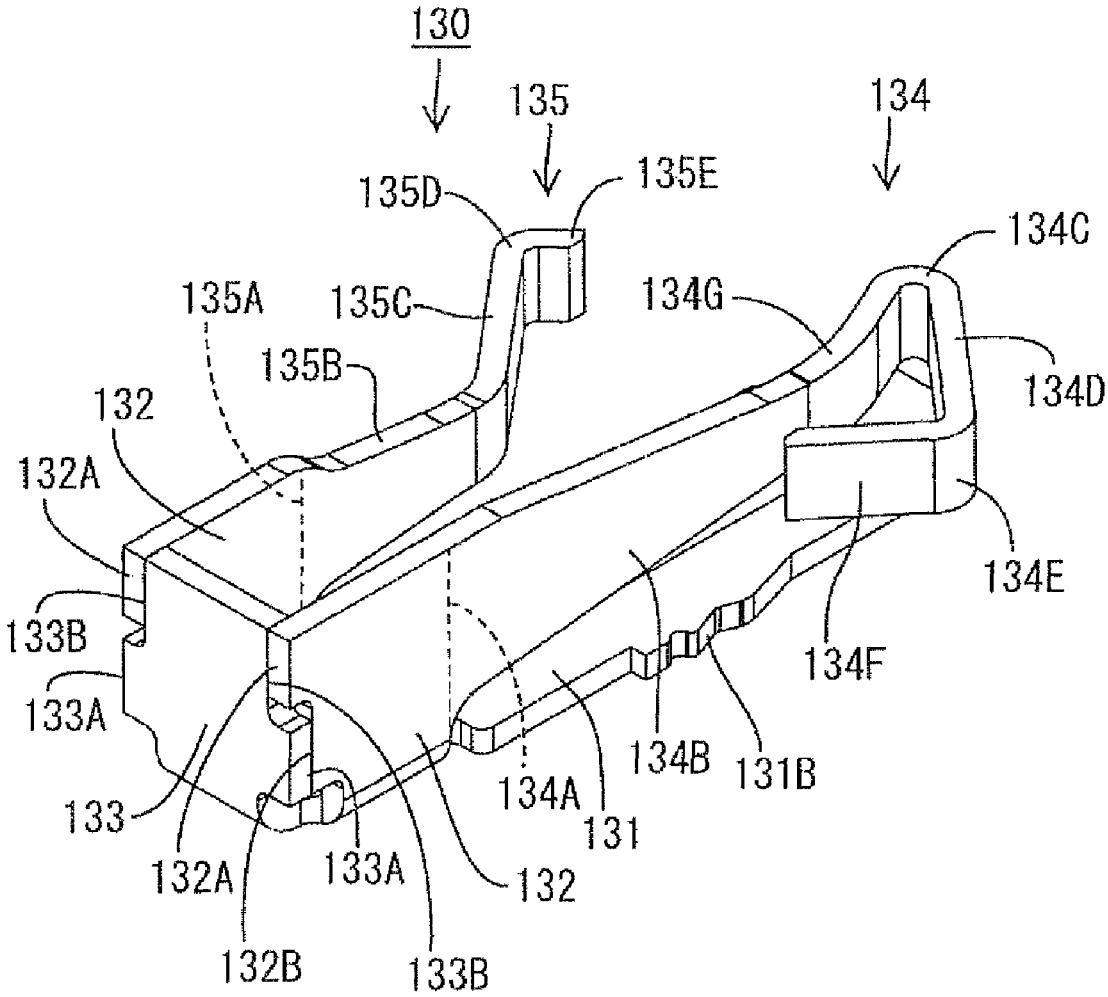
FIG. 40 is a perspective view showing the shorting terminal when viewed obliquely from behind.

Upper parts of the opposite lateral edges of the rear wall 133 are cut off by the thickness of the opposite side walls 132 to form cutouts 133B, as shown in FIG. 40. Upper parts 132A of the rear edges of the opposite side walls 132 are engaged with the cutouts 133B in the lateral direction. Thus, the opposite side walls 132 cannot incline laterally inward (see FIG. 44).

Figure 42:
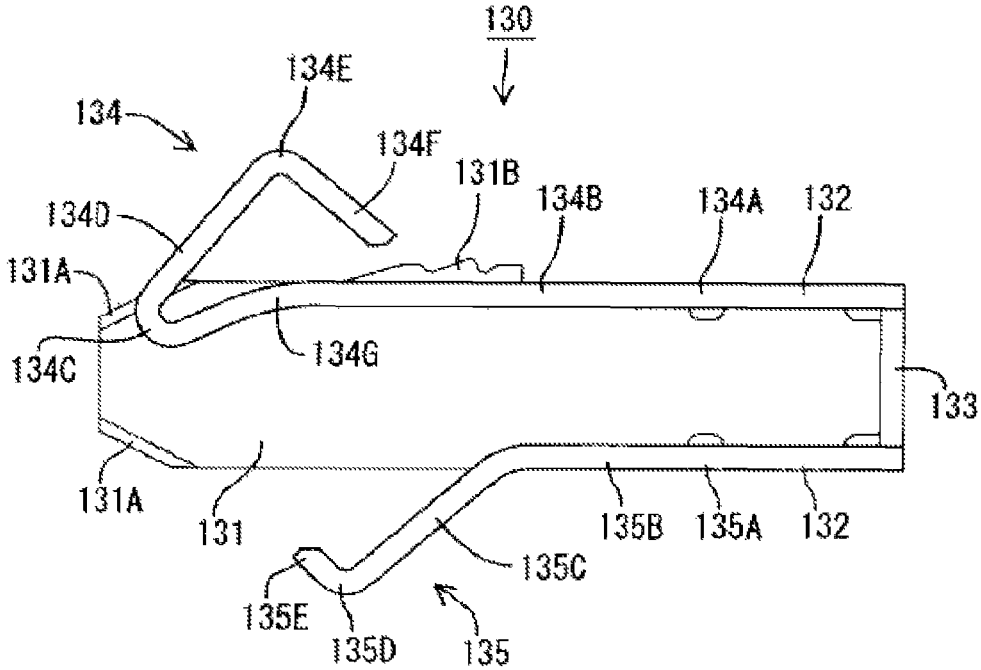
FIG. 42 is a plan view of the shorting terminal.

As shown in FIG. 42, the first contact piece 134 has a first support 134A at the front of the right side wall 132. A first panel 134B extends forward from the first support 134A and continues to a second support 134C. A second panel 134D is folded out from the second support 134C and extends obliquely back to a contact point 134E. A third panel 134F is bent to extend obliquely in and back from contact point 134E.

The first panel 134B is resiliently deformable inward with the first support 134A as a base end when the second support 134C receives an inwardly acting force. In other words, the second support 134C functions as a point of force application. On the other hand, the second panel 134D is resiliently deformable inward with the second support 134C as a base end when the contact point 134E receives an inwardly acting force. The third panel 134F is resiliently deformable inward together with the second panel 134D when the contact point 134E receives an inward acting force.

A distance from the first support 134A to the second support 134C is longer than a distance from the first support 134A to the contact point 134E. Thus, a force smaller than the one received by the contact point 134E acts on the second support 134C. The first support 134A is sufficient to support the force acting on the second support 134C. Therefore, a resilient force of the first support 134A can be smaller than in the case where the contact point 134E functions as a point of force application of the first support 134A (e.g. in the case of such a construction as that of the second contact piece 135).

Further, a resilient force of the second support 134C is set to be smaller than that of the first support 134A. Thus, when the contact point 134E receives an inwardly acting force, the second and third panels 134D and 134F first are displaced inwardly with the second support 134C as the base end. The first, second and third panels 134B, 134D and 134F then are displaced inwardly together with the first support 134A as the base end. In this way, the first contact piece 134 has a two-supporting-point structure capable of resilient deformation at the first and second supports 134A, 134C.

As shown in FIG. 42, the second contact piece 135 has a support 135A at the front end of the left side wall 132 and a first panel 135B extends forward from the support 135A. A second panel 135C is bent to extend obliquely out and forward from the front end of the first panel 135B to a contact point 135D. A third panel 135E is bent to extend obliquely in and forward from the contact point 135D.

Figure 46:
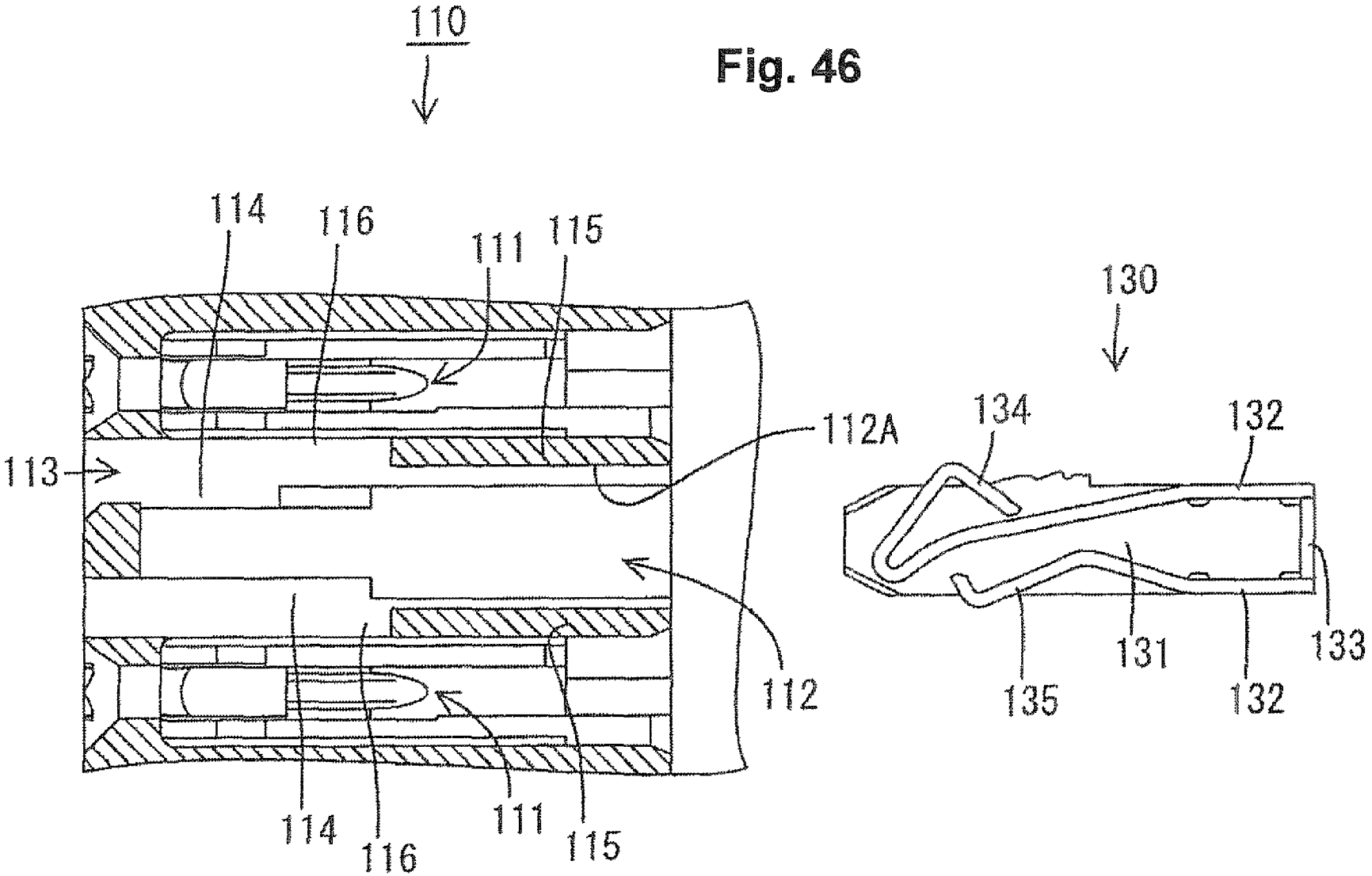
FIG. 46 is a plan view in section showing a state viewed from above after the both contact pieces are brought closer to each other.
Figure 47:
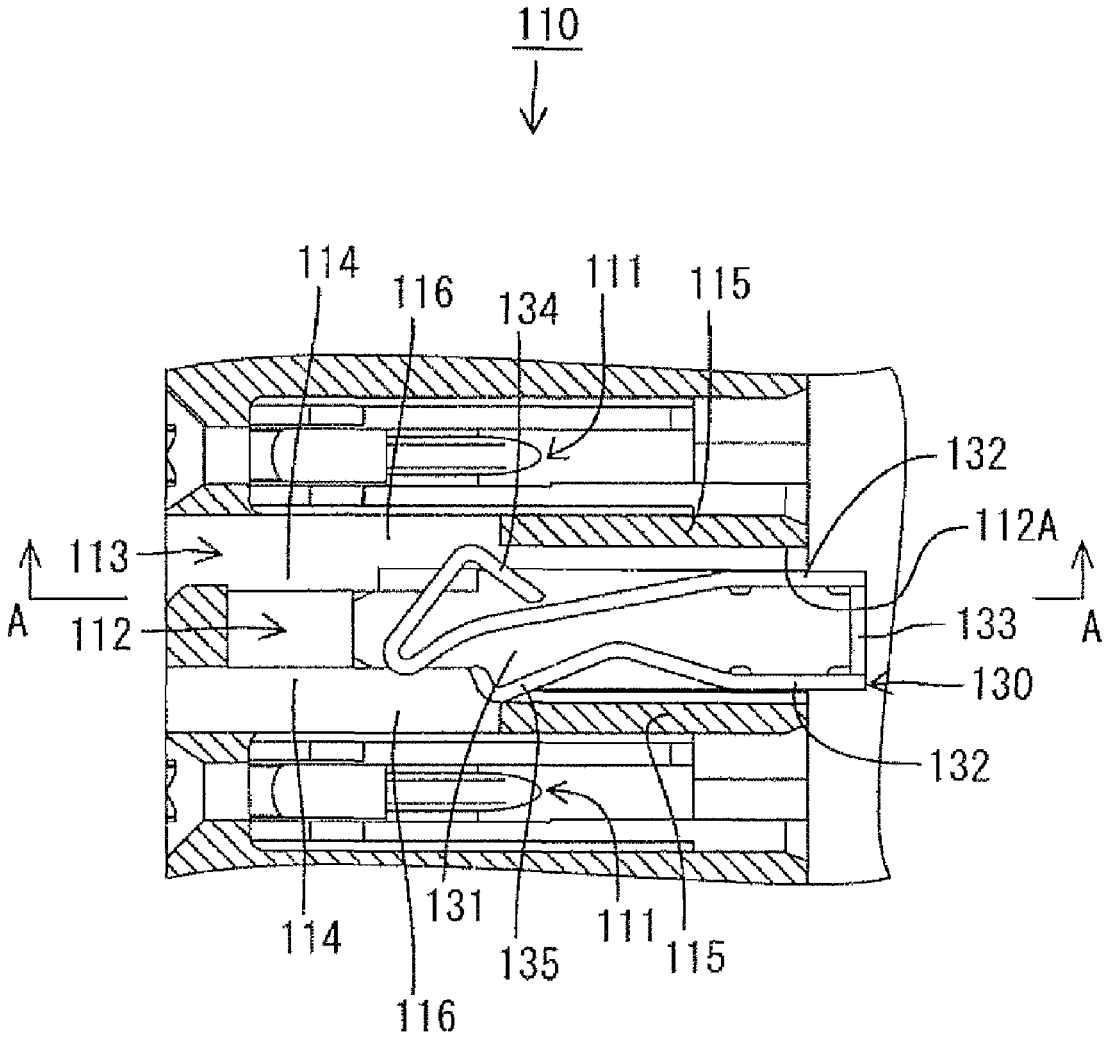
FIG. 47 is a plan view in section showing from above during insertion of the shorting terminal into the terminal accommodating portion.

As shown in FIG. 42, the first panel 134B of the first contact piece 134 includes a bend 134G that is bent inwardly. The bend 134G is provided to avoid interference of the leading end of the third panel 135E of the second contact piece 135 with the first panel 134B of the first contact piece 134 when the contact pieces 134, 135 are brought to close postures to approach each other, as shown in FIG. 46. More specifically, the first panel 134B of the first contact piece 134 in a natural state extends forward from the first support 134A to the bend 134G, is bent substantially in at the bend 134G and then extends obliquely forward from the bend 134G to the second support 134C. Thus, the contact pieces 134, 135 are inserted into the terminal accommodating portion 112 while being kept in the close postures as shown in FIG. 47 and return to their natural states at the proper insertion position shown in FIG. 48.

At the proper insertion position, the first contact piece 134 is arranged so that the second support 134C is located in the terminal accommodating portion 112 so as to be retracted from an entrance path for the releasing rib R and the contact point 134E is located in the cavity 111. Thus, only a front inclined surface of the second panel 134D is in the entrance hole 113 and defines a front guiding surface for guiding the releasing rib R backward. On the other hand, the rear end of the third panel 134F is arranged in the entrance hole 113 and a rear inclined surface of the third panel 134F is located in the cavity 111 and defines a rear guiding surface for guiding the terminal fitting 120 forward.

Figure 43:
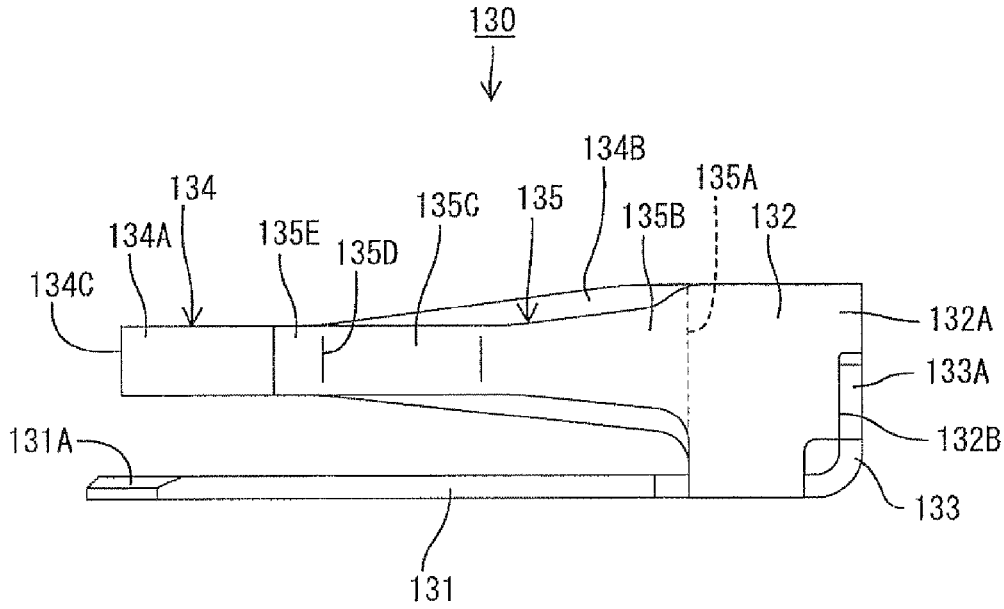
FIG. 43 is a side view of the shorting terminal.
Figure 44:
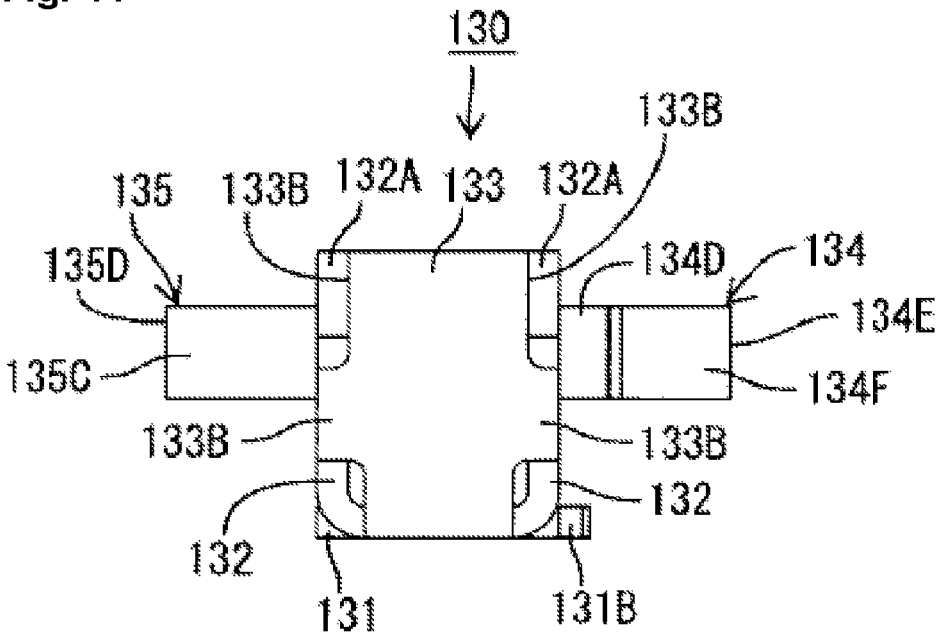
FIG. 44 is a rear view of the shorting terminal.
Figure 45:
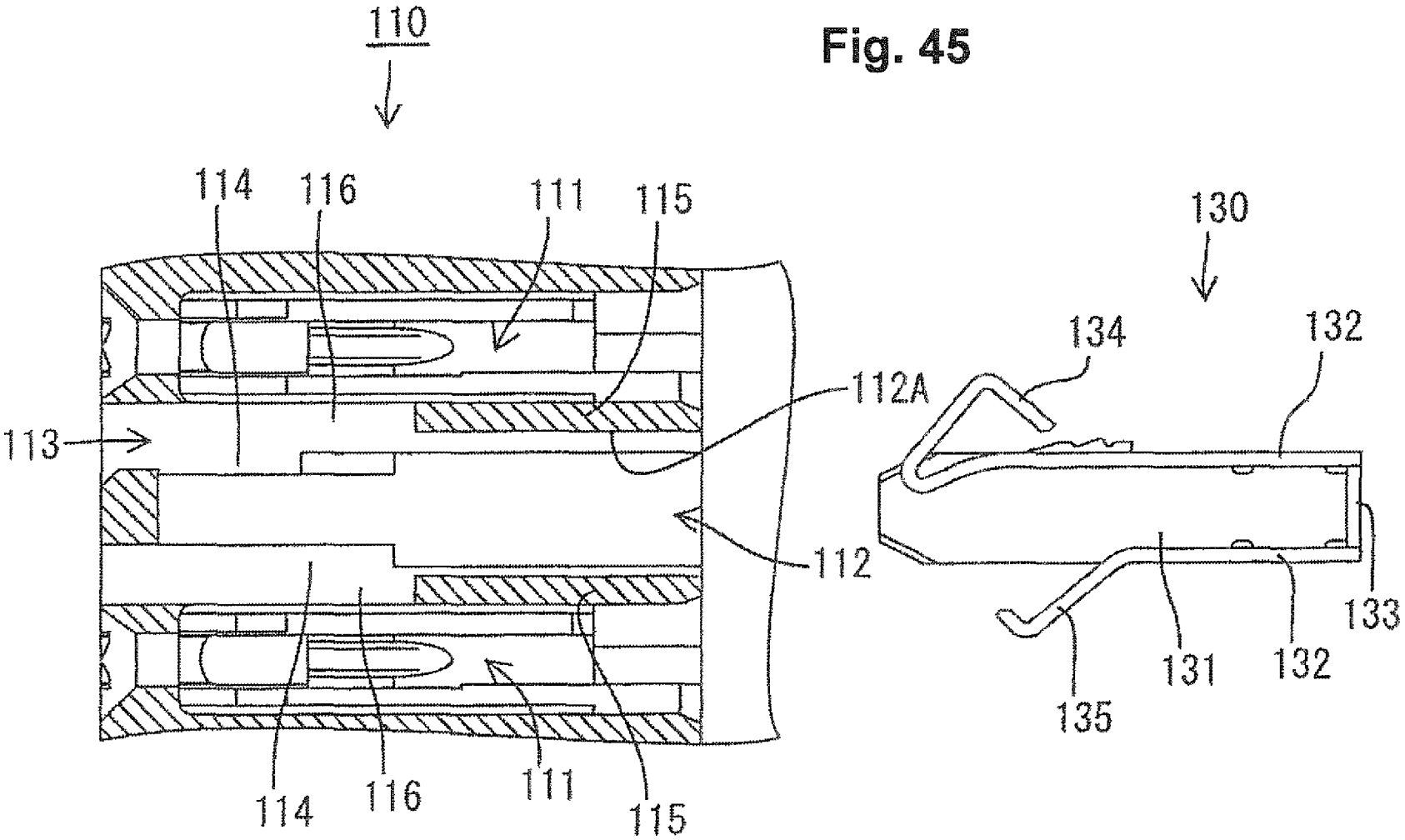
FIG. 45 is a plan view in section showing a state viewed from above before the shorting terminal is inserted into a terminal accommodating portion and both contact pieces are brought closer to each other.
Figure 49:
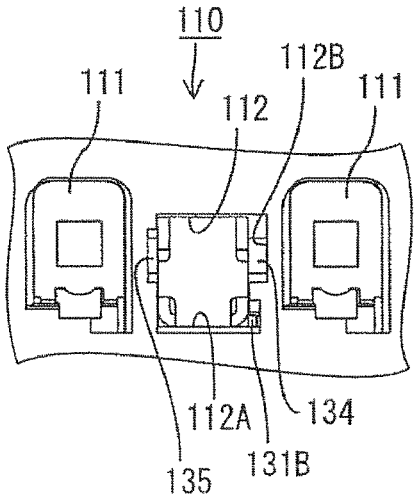
FIG. 49 is a rear view showing a state viewed from behind before the shorting terminal is inserted into the terminal accommodating portion.
Figure 50:
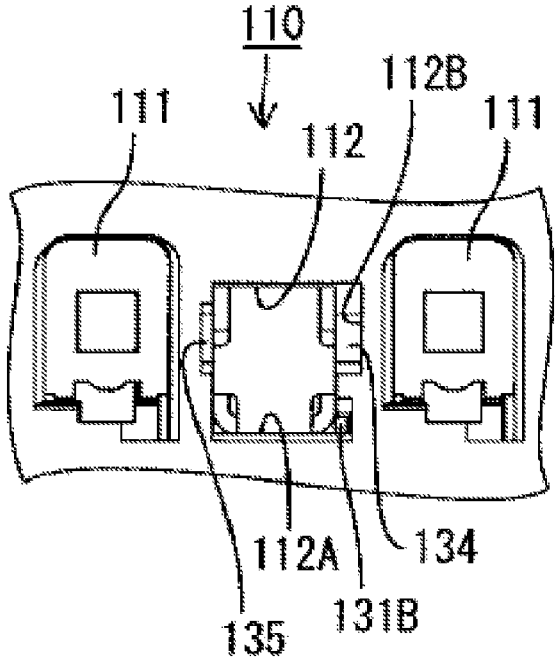
FIG. 50 is a rear view showing a state viewed from behind after the shorting terminal is inserted into the terminal accommodating portion.

The contact pieces 134, 135 extend substantially parallel to the bottom wall 131, as shown in FIG. 43. On the other hand, the terminal accommodating portion 112 for accommodating the contact pieces 134, 135 has a lower accommodating portion 112A for accommodating the bottom wall 131 in a pressed-in state and an upper accommodating portion 112B for accommodating the contact pieces 134, 135 as shown in FIG. 49 or 50. The biting portion 131B of the bottom wall 131 starts biting in the right side surface of the lower accommodating portion 112A upon reaching an intermediate position, as shown in FIG. 52. The intermediate position is the position of the shorting terminal 130 shown in FIGS. 47, 51 and 52.

Figure 51:
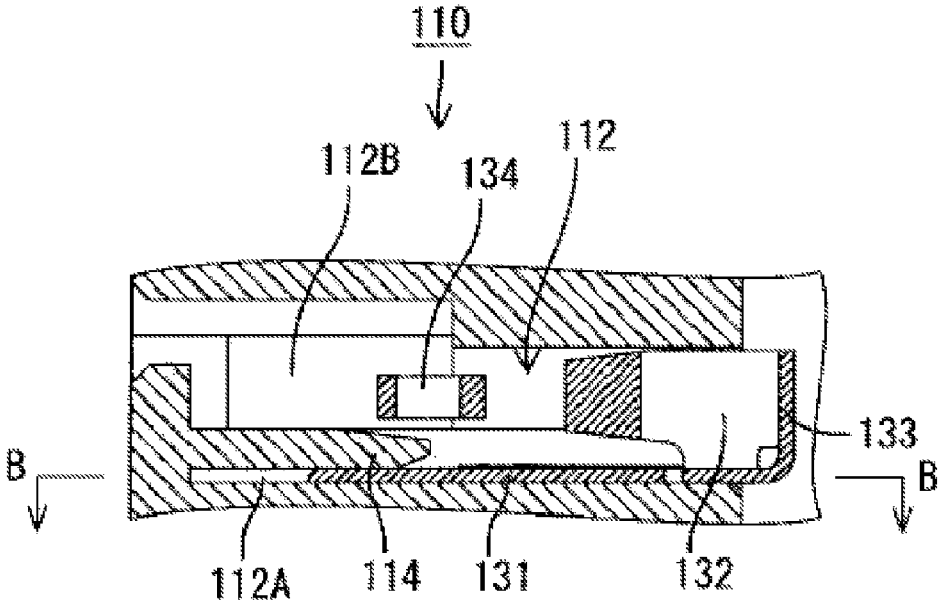
FIG. 51 is a section along A-A of FIG. 47.
Figure 52:
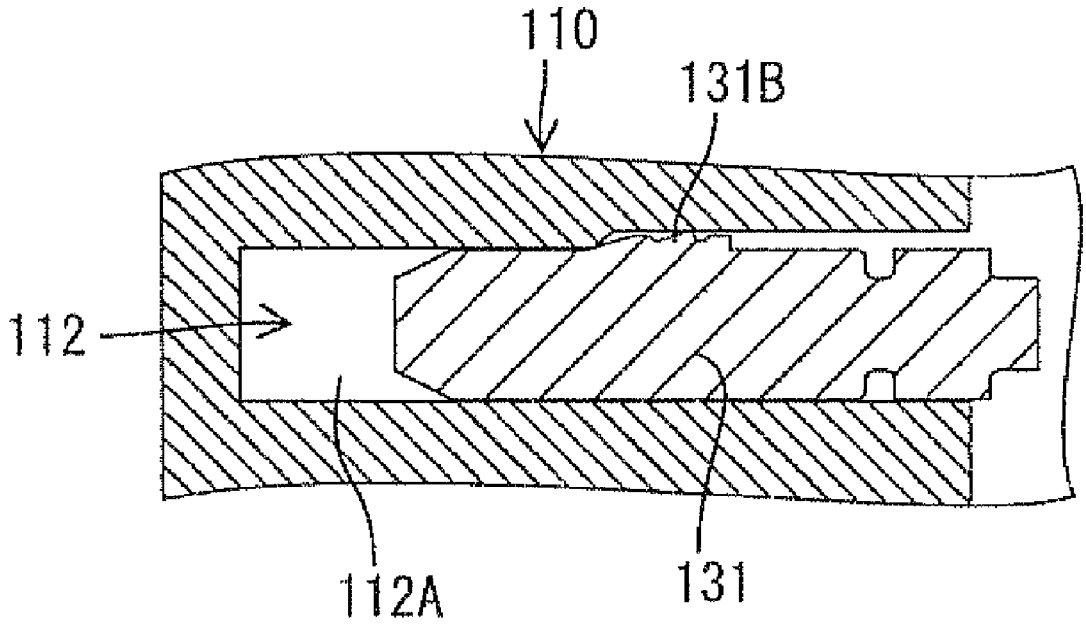
FIG. 52 is a section along B-B of FIG. 51.

Supporting walls 114 form part of the upper surface of the lower accommodating portion 112A and cantilever back from the front surface of the lower accommodating portion 112A, as shown in FIG. 51. Two supporting walls 114 are provided while being laterally spaced apart, as shown in FIG. 49. A spacing between the supporting walls 114 and the bottom surface of the lower accommodating portion 112A is substantially equal to the thickness of the bottom wall 131.

The slanted surfaces 131A enable the bottom wall 131 to be inserted smoothly between the supporting walls 114 and the bottom surface of the lower accommodating portion 112A. At an intermediate position, the upper edges of the opposite side walls 132 contact the upper surfaces of the terminal accommodating portion 112. Thus, the shorting terminal 130 is held in a proper posture and cannot shake vertically in the terminal accommodating portion 112.

The biting portion 131B bites into the right side surface of the lower accommodating portion 112A when the bottom wall 131 at the intermediate position is pressed into the lower accommodating portion 112A. Thus, the bottom wall 131 is retained so as not to come out backward and the front end thereof is held tightly held between the supporting walls 114 and the bottom surface of the lower accommodating portion 112A to prevent upward movement. In this way, the shorting terminal 130 can be inserted to the proper insertion position and held in the proper posture.

Figure 48:
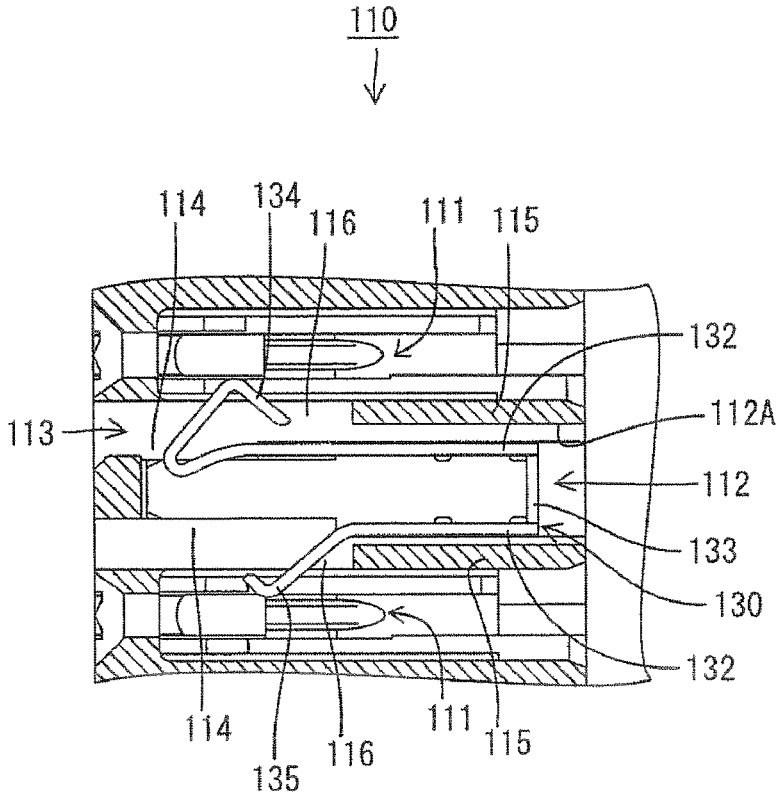
FIG. 48 is a plan view in section showing a state viewed from above after the shorting terminal is inserted into the terminal accommodating portion.

Insertion holes 116 penetrate the partition walls 115 between the terminal accommodating portion 112 and the cavities 111 in a front part of the upper accommodating portion 112B. The contact points 134E, 135D slide forward on the partition walls 115 as the shorting terminal 130 is inserted into the terminal accommodating portion 112, as shown in FIG. 47. The contact pieces 134, 135 move through the respective insertion holes 116 and into the respective cavities 111 to return to their natural states when the shorting terminal 130 reaches the proper insertion position, as shown in FIG. 48.

A dimension of the shorting terminal 130 in forward and backward directions conceivably could be shortened by extending the contact pieces 134, 135 forward from the opposite lateral edges of the rear wall 133 in FIG. 43 and by eliminating the side walls 132. However, if the contact pieces 134, 135 and the rear wall 133 were formed unitarily, the contact pieces 134, 135 would bulge out at the opposite left and right sides of the rear wall 133 in an unfolded state of FIG. 41. Thus, pitches between shorting terminals 130 would increase and the number of shorting terminals 130 obtained per unit area would decrease. However, in this embodiment, the opposite side walls 132 are provided and the contact pieces 134, 135 bulge forward from the front edges of the side walls 132. Thus, the bottom wall 131 and the contact pieces 134, 135 can be parallel and pitches between shorting terminals 130 become smaller so that the number of shorting terminals 130 obtained per unit area increases.

The terminal fittings 120 may not be accommodated in some of the cavities 111. Even in such a case, the shorting terminals 130 can be accommodated in all the terminal accommodating portions 112 and the releasing ribs R are inserted into all of the entrance holes 13. Thus, in the following description, a case where the terminal fittings 120 are accommodated in the cavities 111 and a case where the terminal fittings 120 are not accommodated in the cavities 111 are described separately.

The case where the terminal fittings 120 are accommodated in the cavities 111 is described with reference to FIGS. 34 and 35. More particularly, the terminal fitting 120 is inserted into the cavity 111 from behind. The second and third panels 134D, 134F are displaced inwardly earlier than the first panel 134B with the second support 134C as the base, and the front end of the terminal fitting 120 slides on the rear inclined surface of the third panel 134F. When deformation of the second support 134C approaches a resiliency limit, the first panel 134B starts being displaced inwardly with the first support 134A as the base. Consequently, when the contact point 134E moves onto the side surface of the terminal fitting 120, the contact point 134E and the terminal fitting 120 are held in contact by the spring elasticity of the supports 134A, 134C.

Figure 34:
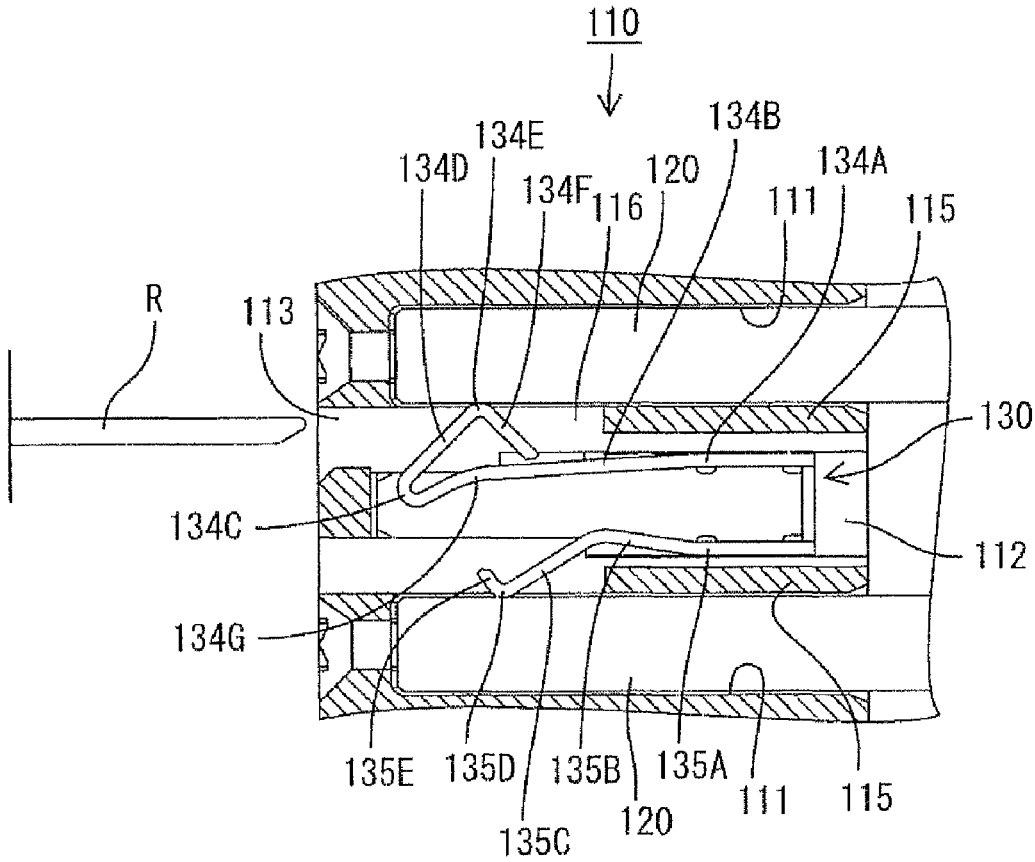
FIG. 34 is a side view in section showing a state viewed sideways before a releasing rib is inserted into an entrance hole in the case where terminal fittings are accommodated in cavities.

The two terminal fittings 120 are shorted electrically by the shorting terminal 130 when the terminal fittings 120 are inserted into the cavities 111 to the proper insertion positions shown in FIG. 34. Thereafter, the two connectors are connected. Each releasing rib R enters the entrance hole 113 from the front and is guided to the back of the entrance hole 113 by the sliding contact of the leading end of the releasing rib R with the front inclined surface of the second main portion 134D.

Figure 35:
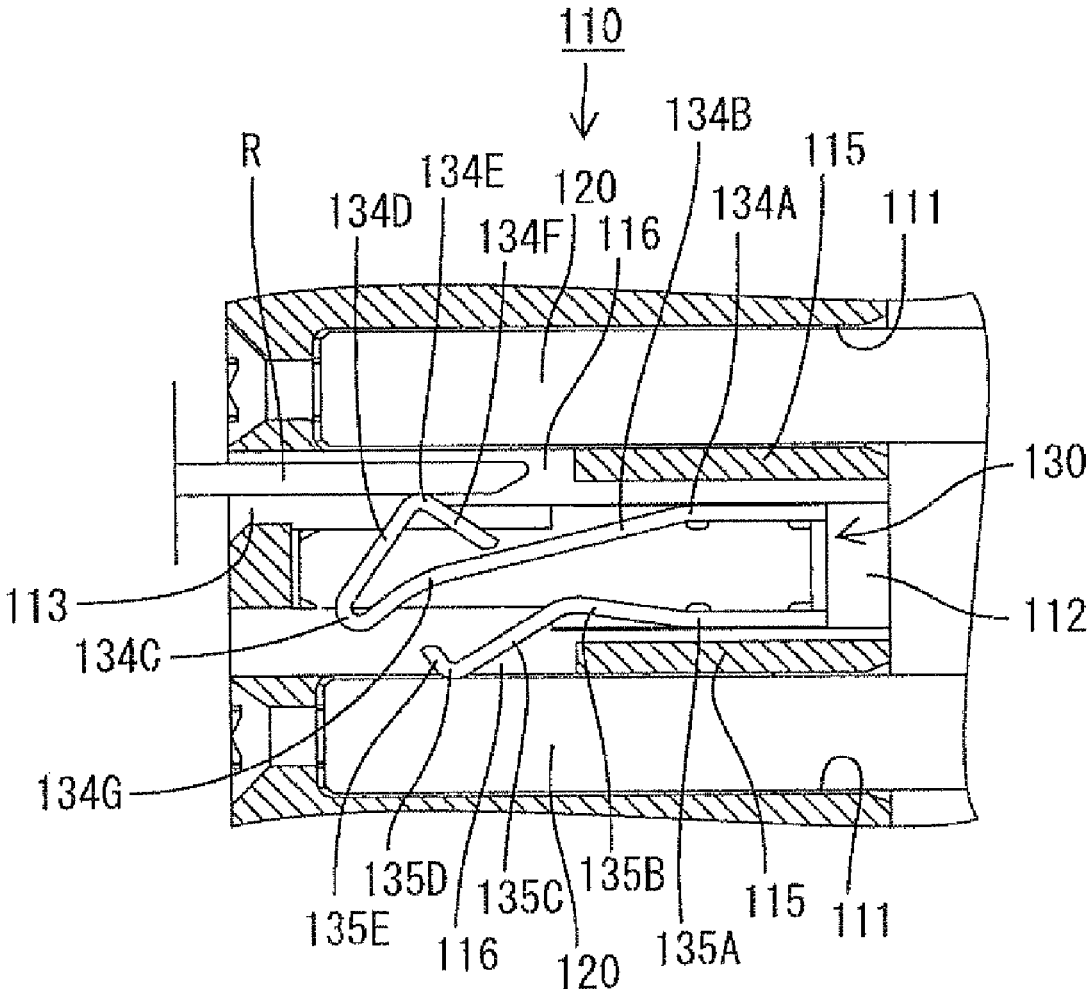
FIG. 35 is a side view in section showing a state viewed sideways after the releasing rib is inserted into the entrance hole.

Thereafter, the releasing rib R moves between the contact point 134E and the terminal fitting 120, as shown in FIG. 35, and the two terminal fittings 120 are disconnected electrically. The force of the releasing rib R on the contact point 134E is transmitted to the second support 134C and the first support 134A is deformed resiliently with the second support 134C as a point of force application. The second support 134C is more distant from the first support 134A than the contact point 134E. Thus, a force acting on the second support 134C is smaller than the force acting on the contact point 134E. Accordingly, the contact piece 134 can have a lower elasticity than in the conventional structure (e.g. a structure in which a force received by the contact point 135D acts directly on the support 135A as in the second contact piece 135). Thus the shorting terminal 130 can be smaller and lighter weight.

Figure 37:
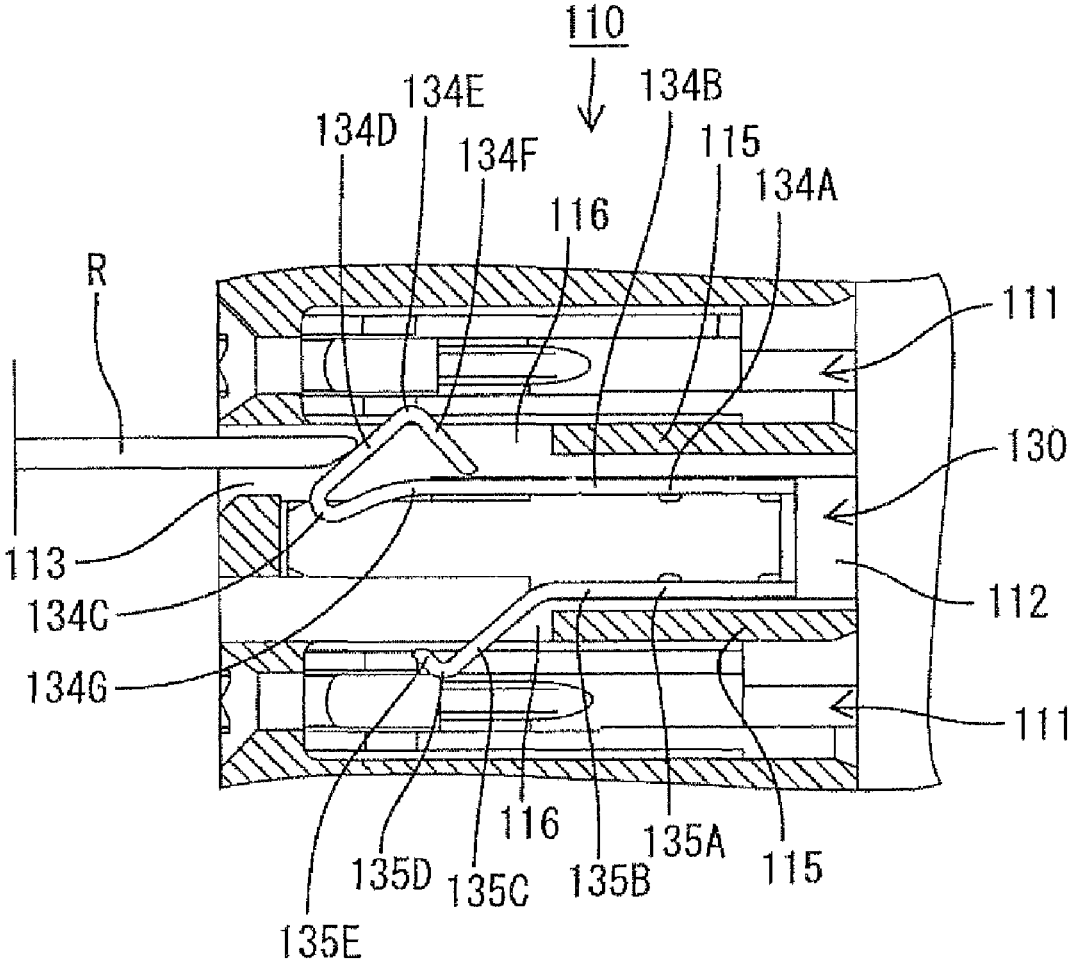
FIG. 37 is a side view in section showing a state viewed sideways during the insertion of the releasing rib into the entrance hole.
Figure 38:
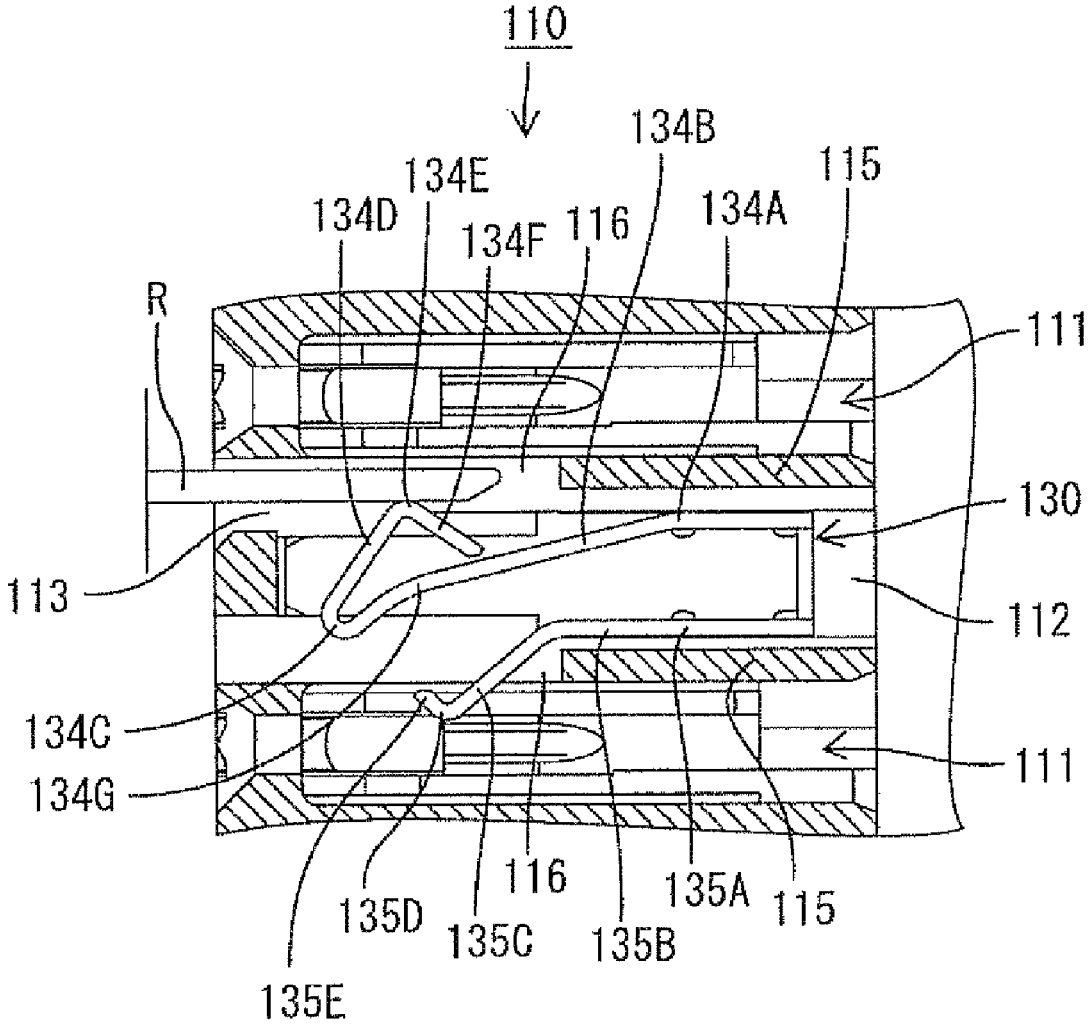
FIG. 38 is a side view in section showing a state viewed sideways after the releasing rib is inserted into the entrance hole.

The case where the terminal fittings 120 are not accommodated in the cavities 111 is described with reference to FIGS. 36 to 38. In this case, the second panel 134D might be thought to be buckled easily by the releasing rib R since the front inclined surface of the second panel 134D is steeper than in the case where the terminal fittings 120 are accommodated in the cavities 111. However, the resilient force of the second support 134C is smaller than that of the first support 134A. Thus, the second support 134C is deformed earlier and the second panel 134D is not buckled. Further, since the front inclined surface of the second panel 134D can be steeper, the first contact piece 134 can be shortened more in forward and backward directions than in the case where the front inclined surface of the second panel 134D has a moderate inclination.

In such a construction, when the terminal fittings 120 are inserted into the cavities 111 to the proper insertion positions shown in FIG. 36 and the two connectors are connected, each releasing rib R enters the entrance hole 113 from the front and the sliding contact of the leading end of the releasing rib R with the front inclined surface of the second panel 134D guides the releasing rib R to the back of the entrance hole 113.

Thereafter, when the deformation of the second supporting point 134C approaches the resiliency limit, the first panel 134B starts being displaced inwardly with the first support 134A as the base. The contact point 134E moves onto the side surface of the releasing rib R and is held in contact by the spring elasticity of the supports 134A, 134C, as shown in FIG. 38.

As described above, the first contact piece 134 has a two-supporting-point structure and is resiliently deformable at the first and second supports 134A, 134C. Additionally, the resilient force of the second support 134C is smaller than that of the first support 134A. Thus, the front inclined surface of the second panel 134D can be made steeper to shorten the first contact piece 134 in forward and backward directions. Further, the second support 134C, which is the point of force application of the first support 134A is arranged before the contact point 134E. Thus, a force to act on the first support 134A can be reduced and the contact piece 134 can have low spring elasticity.

The opposite side walls 132 and the rear wall 133 are engaged with each other in the lateral direction and forward and backward directions. Thus, the right side wall 132 will not incline to the left, the left side wall 132 will not incline to the right and the rear wall 133 will not incline forward.

The contact pieces 134, 135 are arranged between the two laterally adjacent terminal fittings 120. Thus, the shorting terminal 130 is arranged efficiently in the housing 110 and the housing 110 can be miniaturized. Further, the second support 134C is arranged in the terminal accommodating portion 112 to avoid the entrance path for the releasing rib R. Thus, the releasing rib R that has entered the entrance hole 113 will not interfere with the second support 134C. Furthermore, the first panel 134B has the bend 134G to ensure that the leading end of the third panel 135E of the second contact piece 135 does not interfere with the first panel 134B of the first contact piece 134 when the contact pieces 134, 135 are in the close postures.

The invention is not limited to the above described and illustrated embodiments. For example, the following embodiments are also embraced by the technical scope of the present invention as defined by the claims.

Although the shorting terminal includes the supporting base in the above embodiments, it may include only the contact pieces according to the invention. For example, two front and rear walls may be provided at the front and rear ends of the terminal accommodating portion to retain the contact pieces and entrance holes for permitting the both contact pieces to enter the terminal accommodating portion may be formed in the rear wall.

The circuit board connector is illustrated as the male connector 30 in the above embodiments. However, the male connector 30 may be connected directly with the wires W and/or mounted to an electric or electronic device, such as a junction box.

Both contact pieces 41 and both female terminal fittings 20 are brought out of contact using two releasing ribs 35 in the first embodiment. However, one of the contact pieces 41 and the corresponding female terminal fitting 20 may be brought out of contact using one releasing rib 35.

The leading ends of both contact pieces 51A, 51B are displaced in forward and backward directions in the second embodiment. However, they may be displaced vertically.

The contact pieces 61 are displaced toward each other in the third embodiment. However, the guide 70C may be formed vertically so that both contact pieces 61 are displaced down. In this case, resilient forces of both contact pieces 61 against the supporting base 62 are stronger so that both downwardly displaced contact pieces 61 can be restored to original postures.

The joint 83 is connected with the supporting base 82 in the fourth embodiment. However, a part other than the joint 83 may be connected with the supporting base 82. Thus, the "connecting portion" and the "joint" may not necessarily be the same.

The fold 84 is deformed resiliently in the fourth embodiment. However, a part extending from the fold 84 to the leading end of the first contact piece 81A may be entirely resiliently deformed according to the invention.

The joint 52 is substantially in the lateral center of the terminal accommodating portion 13 in the fifth embodiment. However, it may be displaced to the right side in the terminal accommodating portion 13 by being connected with the supporting base according to the present invention.

Although stress concentration is avoided by rounding the first contact piece 81A or making the left contact piece 51A longer in the fourth or fifth embodiment, the contact piece may be shaped so that stress is difficult to concentrate by adjusting the thickness and/or width of the contact piece.

The first support 134A starts being resiliently deformed after the second support 134C approaches its resiliency limit in the six embodiment. However, it is sufficient that the second support 134C is deformed to a larger degree than the first support 314A and both supports 134A, 134C may simultaneously start being resiliently deformed according to the invention.

Although the opposite side walls 132 are supported on the bottom wall 131 in the sixth embodiment, they may be connected by the rear wall 133 without providing the bottom wall 131 according to the present invention.

The side walls 132 prevent the rear wall 133 from being inclined inwardly in the sixth embodiment. However, the structure for preventing the inclination of the rear wall 133 may not be provided.

Although the shorting terminal 130 is arranged between the two laterally adjacent terminal fittings 120 in the sixth embodiment, it may be between two vertically adjacent terminal fittings 120 according to the invention.

The second support 134C is arranged to avoid the entrance path for the releasing rib even before the entrance of the terminal fitting 120 in the sixth embodiment. However, the second support 134C may be in the entrance path for the releasing rib R and the second panel 134D may be displaced inwardly upon the insertion of the terminal fitting 120 so that the second support 134C is retracted from the entrance path for the releasing rib R.

Although the first panel 134B is bent inwardly at an intermediate position to form the bend 134G in the sixth embodiment, the bent portion may be formed by folding the first panel 134B inwardly after bending it outwardly at an intermediate position according to the present invention.

What is claimed is:

1. A connector, comprising:

a housing;

terminal fittings arranged in vertical and lateral directions in the housing; and a shorting terminal disposed in the housing and having first and second contact pieces contacting and shorting two of the terminal fittings that are laterally adjacent one another;

wherein at least one releasing rib can be thrust between at least one of the contact pieces and at least one of the terminal fittings that is laterally adjacent to respective contact piece to release the shorting of the terminal fittings and wherein the contact pieces are arranged in an entrance path for the releasing rib and are displaced vertically to move to a position retracted from the entrance path for the releasing rib by sliding contact with the releasing rib.

2. The connector of claim 1, wherein the shorting terminal includes a supporting base for retaining the contact pieces in the housing by supporting a connecting portion connecting the base ends of the contact pieces with each other and being fixed in the housing between two of the laterally adjacent terminal fittings.

3. A connector, comprising:

a housing;

terminal fittings arranged in vertical and lateral directions in the housing;

a shorting terminal disposed in the housing and having first and second contact pieces contacting and shorting two of the terminal fittings that are laterally adjacent one another;

wherein at least one releasing rib can be thrust between at least one of the contact pieces and at least one of the terminal fittings that is laterally adjacent to respective contact piece to release the shorting of the terminal fittings, and wherein the contact pieces are substantially U-shaped, and a joint connecting base ends of the contact pieces is arranged closer to the terminal fitting held in contact with the second contact piece than to the terminal fitting held in contact with the first contact piece.

4. The connector of claim 3, wherein a distance from the joint connecting the base ends of the contact pieces to the leading end of the first contact piece is longer than that from the joint to the leading end of the second contact piece.

5. A shorting terminal to be arranged between two adjacent terminal fittings for shorting the terminal fittings, the shorting terminal comprising:

first and second contact pieces to be held respectively in contact with the two terminal fittings, the first contact piece extending forward from a first support to a second support, folded at the second support to extend obliquely out and back toward a contact point and folded at the contact point to extend obliquely in and back, thereby being resiliently deformable at the first and second supports, a resilient force of the second support being smaller than a releasing force of the first support.

6. The shorting terminal of claim 5, comprising a bottom wall, a rear wall standing up from a rear edge of the bottom wall and two side walls respectively supporting the corresponding contact pieces, the opposite side walls standing up from the opposite lateral edges of the bottom wall while substantially facing each other, and the rear wall being arranged between the opposite side walls.

7. A connector, comprising:

a housing;

a plurality of terminal fittings arranged in vertical and lateral directions in the housing;

a shorting terminal having first and second contact pieces to be held respectively in contact with the two terminal fittings, the first contact piece extending forward from a first support to a second support, folded at the second support to extend obliquely out and back toward a contact point and folded at the contact point to extend obliquely in and back, thereby being resiliently deformable at the first and second supports, a resilient force of the second support being smaller than a releasing force of the first support, the contact pieces being arranged between two laterally adjacent terminal fittings; and at least one releasing rib to be thrust between at least one of contact pieces and a corresponding one of the terminal fittings to release a shorted state.

8. The connector of claim 7, wherein:

the housing includes at least one entrance hole for permitting entry of the releasing rib from and a terminal accommodating portion communicating with an interior of the entrance hole and adapted to accommodate the shorting terminal, and the second support being arranged in the terminal accommodating portion to avoid an entrance path for the releasing rib.

9. The connector of claim 8, wherein:

the shorting terminal is inserted into the terminal accommodating portion with both contact pieces kept in postures close to each other, and the first contact piece being bent so as not to touch the second contact piece in the close posture.

10. A connector, comprising:

a housing;

terminal fittings arranged in vertical and lateral directions in the housing;

and a shorting terminal disposed in the housing and having first and second contact pieces contacting and shorting two of the terminal fittings that are laterally adjacent one another, the contact pieces being arranged to face each other laterally, and leading ends of the contact pieces being folded inwardly and displaced in forward and backward directions that intersect the vertical and lateral directions;

wherein at least one releasing rib can be thrust between the first contact piece and at least one of the terminal fittings that is laterally adjacent to the first contact piece to release the shorting of the terminal fittings.

* * * * *